US010299594B2

(12) United States Patent
Liss et al.

(10) Patent No.: US 10,299,594 B2
(45) Date of Patent: May 28, 2019

(54) SHELVING UNIT WITH CAPACITY INCREASING TIE MEMBERS

(71) Applicant: Edsal Manufacturing Company, Inc., Chicago, IL (US)

(72) Inventors: Mitchell Liss, Northbrook, IL (US); David J. Wojtowicz, Orland Park, IL (US); Anthony J. Troyner, Shorewood, IL (US); Jeff Lamber, Minooka, IL (US); Mitchell E. Bianchin, Villa Park, IL (US); Scott Fitzgerald, Lowell, IN (US)

(73) Assignee: Edsal Manufacturing Company, Inc., Chicago, IL (US)

( * ) Notice: Subject to any disclaimer, the term of this patent is extended or adjusted under 35 U.S.C. 154(b) by 0 days.

(21) Appl. No.: 15/937,061

(22) Filed: Mar. 27, 2018

(65) Prior Publication Data

US 2018/0279782 A1 Oct. 4, 2018

Related U.S. Application Data

(60) Provisional application No. 62/640,908, filed on Mar. 9, 2018, provisional application No. 62/610,210, filed
(Continued)

(51) Int. Cl.
*A47B 47/00* (2006.01)
*A47B 47/02* (2006.01)
(Continued)

(52) U.S. Cl.
CPC ..... *A47B 96/1441* (2013.01); *A47B 47/0041* (2013.01); *A47B 47/0083* (2013.01);
(Continued)

(58) Field of Classification Search
CPC ... A47B 47/021; A47B 47/027; A47B 47/028; A47B 57/50; A47B 57/402; A47B 57/22;
(Continued)

(56) References Cited

U.S. PATENT DOCUMENTS 2,815,130 A * 12/1957 Franks ..... A47B 57/402 182/178.1
RE24,535 E * 9/1958 Franks ..... A47B 57/402 211/187

(Continued)

*Primary Examiner* — Jennifer E. Novosad
(74) *Attorney, Agent, or Firm* — Wood Herron & Evans LLP

(57) ABSTRACT

A tie bar for connecting two horizontal beams includes first and second elongate walls arranged parallel to each other, and a third elongate wall arranged perpendicular to the first and second elongate walls and coupled to a lateral side of each of the first and second elongate walls. The tie bar further includes at least one pair of hook elements positioned at terminal ends of at least one of the first, second, or third elongate walls. Each of the hook elements includes a depending tab configured to be received by an elongate slot of a horizontal beam of a shelving unit. The first and second elongate walls may be top and bottom walls, respectively, the third elongate wall may be a side wall, and the at least one pair of hook elements may include first and second hook elements positioned on the second elongate wall.

33 Claims, 22 Drawing Sheets

Related U.S. Application Data on Dec. 24, 2017, provisional application No. 62/577,492, filed on Oct. 26, 2017, provisional application No. 62/477,723, filed on Mar. 28, 2017.

(51) Int. Cl.

| | |
|---|---|
| ***A47B 55/00*** | (2006.01) |
| ***A47B 57/16*** | (2006.01) |
| ***A47B 57/20*** | (2006.01) |
| ***A47B 57/38*** | (2006.01) |
| ***A47B 57/40*** | (2006.01) |
| ***A47B 57/48*** | (2006.01) |
| ***A47B 96/02*** | (2006.01) |
| ***A47B 96/06*** | (2006.01) |
| ***A47B 96/14*** | (2006.01) |

(52) U.S. Cl.

CPC ..... *A47B 47/021* (2013.01); *A47B 47/024* (2013.01); *A47B 47/027* (2013.01); *A47B 47/028* (2013.01); *A47B 55/00* (2013.01); *A47B 57/16* (2013.01); *A47B 57/20* (2013.01); *A47B 57/38* (2013.01); *A47B 57/48* (2013.01); *A47B 96/021* (2013.01); *A47B 96/067* (2013.01); *A47B 57/402* (2013.01)

(58) Field of Classification Search

CPC ..... A47B 57/487; A47B 57/40; A47B 57/425; A47B 57/58; A47B 57/00; A47B 57/16; A47B 96/1441; A47B 96/06; A47B 96/00; A47B 96/02; A47B 96/14; A47B 47/0083; A47B 47/0058; A47B 57/06; A47B 57/08; A47B 57/30; A47B 57/32; A47B 57/34; A47B 57/48; A47B 57/482; A47B 57/485; A47B 96/021; A47B 96/024; A47B 96/028; A47B 96/067; A47B 47/0025; A47B 47/0041; A47B 47/024; A47B 47/045; A47B 57/20; A47B 57/38; A47B 57/404; A47B 57/406; A47B 96/1416; A47F 5/01; A47F 5/13; A47F 5/101; A47F 5/132; A47F 5/14

USPC ..... 211/134, 182, 183, 189, 187, 186, 191, 211/192, 190, 193; 248/214, 220.21, 248/225.21, 300

See application file for complete search history.

(56) References Cited

U.S. PATENT DOCUMENTS 2,895,619 A * 7/1959 Frazier ..... A47B 57/404 211/187
2,918,176 A * 12/1959 Bell ..... A47B 47/027 211/187
2,925,920 A * 2/1960 Skubic ..... A47B 57/402 108/107
2,937,767 A * 5/1960 Butler ..... A47B 47/021 211/187
3,042,221 A * 7/1962 Rasmussen ..... A47B 57/50 211/182
3,048,245 A * 8/1962 Shewell ..... A47B 57/402 211/182
3,142,386 A * 7/1964 Skubic ..... A47B 57/402 211/182
3,266,635 A * 8/1966 McConnell ..... A47B 57/402 211/187
3,285,428 A * 11/1966 Scheck ..... A47B 57/06 211/182
3,297,374 A * 1/1967 Radek ..... A47F 5/103 108/108
3,349,924 A * 10/1967 Maurer ..... A47F 7/0014 211/189
3,353,507 A * 11/1967 Squires ..... A47B 57/42 108/107
3,378,976 A * 4/1968 Meredith, Jr. ..... E04B 9/122 403/145
3,463,325 A * 8/1969 Rogers ..... A47B 57/00 211/187
3,584,904 A * 6/1971 Lickliter ..... E04B 9/122 403/252
3,695,456 A * 10/1972 Lewis ..... A47B 57/402 211/191
3,846,944 A * 11/1974 Lambert ..... A47B 47/021 211/187
3,865,248 A * 2/1975 Donovan ..... A47B 57/06 211/90.01
3,989,399 A * 11/1976 Slowbe ..... E04B 9/127 403/245
4,048,059 A * 9/1977 Evans ..... A47B 96/024 108/155
4,078,664 A * 3/1978 McConnell ..... A47B 96/00 108/159
4,261,470 A * 4/1981 Dolan ..... F16B 12/36 108/55.1
4,285,436 A * 8/1981 Konstant ..... A47B 57/482 211/192
4,342,397 A * 8/1982 Halstrick ..... A47B 57/402 211/182
4,549,665 A * 10/1985 Smitley ..... A47B 57/22 211/191
4,665,838 A * 5/1987 Minshall ..... A47B 47/021 108/157.13
4,955,490 A * 9/1990 Schafer ..... A47B 57/581 211/187
5,011,031 A * 4/1991 Konstant ..... A47B 47/027 211/191
5,012,938 A * 5/1991 King ..... A47B 47/027 211/182
5,189,857 A * 3/1993 Herren ..... E04B 2/58 52/317
5,279,431 A * 1/1994 Highsmith ..... B65G 1/02 211/187
5,310,066 A * 5/1994 Konstant ..... A47B 47/022 108/109
5,415,301 A * 5/1995 Bruton ..... A47B 96/1416 211/183
5,433,327 A * 7/1995 Benvenuti ..... A47B 57/42 108/108
5,577,623 A * 11/1996 Bustos ..... A47B 57/00 108/180
5,628,415 A * 5/1997 Mulholland ..... A47B 47/027 211/186
5,921,412 A * 7/1999 Merl ..... A47B 96/028 211/181.1
6,039,192 A * 3/2000 Hollander ..... A47B 96/021 211/186
6,105,798 A * 8/2000 Gruber ..... B65G 1/023 211/151
6,173,846 B1 * 1/2001 Anderson ..... A47B 47/027 211/183
6,260,318 B1 * 7/2001 Herren ..... E04B 2/7453 52/317
6,520,357 B1 * 2/2003 Kautz ..... A47B 96/061 211/151
7,228,978 B2 * 6/2007 Cross ..... A47B 96/021 211/153
7,614,511 B2 * 11/2009 Konstant ..... A47B 47/021 211/189
7,641,063 B2 * 1/2010 Wishart ..... A47B 47/027 211/189
7,810,770 B2 * 10/2010 Treadwell ..... A47B 47/027 248/200
7,891,507 B2 * 2/2011 Shetler ..... A47B 55/00 211/135
D637,427 S * 5/2011 Troyner ..... D6/705.6

(56) References Cited

U.S. PATENT DOCUMENTS

| | | | | |
|---|---|---|---|---|
| 8,443,992 | B2 * | 5/2013 | Lawson | A47B 47/028 211/187 |
| 9,027,767 | B2 * | 5/2015 | Buckley | A47F 5/00 211/134 |
| 9,215,926 | B1 * | 12/2015 | Offerman | A47B 47/02 |
| 9,215,931 | B1 * | 12/2015 | Offerman | A47B 96/021 |
| 9,247,809 | B1 * | 2/2016 | Hsu | A47B 47/0083 |
| 9,290,322 | B2 * | 3/2016 | Heijmink | A47B 47/0058 |
| 9,375,102 | B2 * | 6/2016 | Troyner | A47B 47/021 |
| 9,386,855 | B2 * | 7/2016 | Sabounjian | A47B 96/14 |
| 10,035,030 | B2 * | 7/2018 | Pigeon | A62C 3/002 |
| 2010/0181274 | A1 * | 7/2010 | Vargo | A47B 47/021 211/187 |
| 2011/0042336 | A1 * | 2/2011 | Cheng | A47B 57/40 211/153 |
| 2017/0280875 | A1 * | 10/2017 | Buckley | A47B 47/021 |
| 2018/0066691 | A1 * | 3/2018 | Matsumoto | F16B 12/50 |

* cited by examiner

SHELVING UNIT WITH CAPACITY INCREASING TIE MEMBERS

CROSS-REFERENCE TO RELATED APPLICATIONS

This application claims the benefit of U.S. Provisional Patent Application Ser. No. 62/477,723, filed Mar. 28, 2017; U.S. Provisional Patent Application Ser. No. 62/577,492, filed Oct. 26, 2017; U.S. Provisional Patent Application Ser. No. 62/610,210, filed Dec. 24, 2017; and U.S. Provisional Patent Application Ser. No. 62/640,908, filed Mar. 9, 2018, the disclosures of which are incorporated by reference herein in their entirety.

TECHNICAL FIELD

This invention relates to shelving units and more particularly, to tie members, such as tie bars and tie rods, used in shelving units for connecting horizontal front and rear shelf-supporting beams.

BACKGROUND

Shelving units are commonly used for storing various items in a space-efficient manner. Typical shelving units may include four vertical supporting posts, any suitable number of horizontal front and corresponding horizontal rear shelf-supporting beams extending respectively between the front pair and rear pair of posts, and a corresponding number of shelves resting on and supported by the pairs of front and rear beams. Such shelving units may be constructed at least partially of sheet metal or formed steel components and are commonly referred to as steel shelving or storage units.

As loads are applied to such shelving units, such as by loading heavy items onto the shelves thereof, the front and rear horizontal beams are susceptible to undesirable twisting or torquing, in cross-section, out of their positions, particularly when strained beyond their capacity to remain in their design position. This twisting presents undesirable structural responses and could lead to shelving unit failure. For example, undue twisting of the front and rear horizontal shelf-supporting beams could separate the supporting interconnection of the shelves to the beams, allowing the beams to pull away from the shelves thereby letting them drop, or could separate the beam ends from the corner posts thereby catastrophically destroying the shelving unit.

Some attempts have been made to address these issues by positioning a tie bar between each pair of horizontal front and rear horizontal shelf-supporting beams. For example, U.S. Pat. No. 9,375,102 discloses shelving units with such tie bars. However, prior art tie bars have a variety of drawbacks. For example, such tie bars offer no direct torque resistance to upper portions of the shelf-supporting beams of the shelving units. As a result, shelving units constructed with such tie bars continue to suffer from undesirably low load-bearing capacities.

It would therefore be desirable to provide tie members for shelving units that improve the structural integrity and load-bearing capacities of the shelving units.

SUMMARY

In one embodiment, a tie bar for connecting two horizontal beams includes first and second elongate walls arranged parallel to each other, and a third elongate wall arranged perpendicular to the first and second elongate walls and coupled to a lateral side of each of the first and second elongate walls. The tie bar further includes at least one pair of hook elements positioned at terminal ends of at least one of the first, second, or third elongate walls. Each of the hook elements includes a depending tab configured to be received by an elongate slot of a horizontal beam of a shelving unit.

In one embodiment, the first and second elongate walls are side walls, the third elongate wall is a top wall, and the at least one pair of hook elements includes first and second hook elements positioned on the third elongate wall. The first and second elongate walls may each include end extensions extending longitudinally beyond the terminal ends of the third elongate wall and the end extensions may each be configured to be received within an interior space of the corresponding horizontal beam. In addition or alternatively, the first and second elongate walls may each include recesses extending inwardly at or near the terminal ends of the third elongate wall and the recesses may each be configured to receive a portion of a flange of the corresponding horizontal beam.

In another embodiment, the first and second elongate walls are top and bottom walls, respectively, the third elongate wall is a side wall, and the at least one pair of hook elements includes first and second hook elements positioned on the second elongate wall. The at least one pair of hook elements may further include third and fourth hook elements positioned on the first elongate wall. In addition or alternatively, the third elongate wall may include end extensions extending longitudinally beyond the terminal ends of the first elongate wall and the end extensions may each be configured to be received within an interior space of the corresponding horizontal beam. The third elongate wall may include recesses extending inwardly at or near the terminal ends of the first elongate wall and the recesses may each be configured to receive a portion of a flange of the corresponding horizontal beam. The tie bar may further include first and second extending tabs positioned at and extending longitudinally beyond the terminal ends of the first elongate wall. Each of the first and second extending tabs may include an opening for receiving a pin configured to securely couple the first elongate wall to the corresponding beam. The first elongate wall may be free of any depending tabs.

In another embodiment, a shelving unit includes such a tie bar.

In another embodiment, a shelving unit includes at least one front horizontal shelf-supporting beam including at least one first flange, at least one first elongate slot, and at least one first interior space. The shelving unit also includes at least one rear horizontal shelf-supporting beam including at least one second flange, at least one second elongate slot, and at least one second interior space. The shelving unit further includes a tie bar connecting the at least one front and rear horizontal shelf-supporting beams. The tie bar includes first and second elongate walls arranged parallel to each other, a third elongate wall arranged perpendicular to the first and second elongate walls and coupled to a lateral side of each of the first and second elongate walls, and at least one pair of hook elements positioned at terminal ends of at least one of the first, second, or third elongate walls. Each of the hook elements includes a depending tab received by one of the at least one first or second elongate slots.

In one embodiment, the first and second elongate walls are top and bottom walls, respectively, the third elongate wall is a side wall, and the at least one pair of hook elements includes first and second hook elements positioned on the second elongate wall. The at least one pair of hook elements may further include third and fourth hook elements positioned on the first elongate wall. In addition or alternatively, the third elongate wall may include end extensions extending longitudinally beyond the terminal ends of the first elongate wall and the end extensions may each be received within one of the at least one first or second interior spaces. The third elongate wall may include recesses extending inwardly at or near the terminal ends of the first elongate wall and the recesses may each receive a portion of one of the at least one first or second flanges. The shelving unit may further include first and second extending tabs positioned at and extending longitudinally beyond the terminal ends of the first elongate wall. Each of the first and second extending tabs may include an opening for receiving a pin configured to securely couple the first elongate wall to the corresponding beam. The first elongate wall may be free of any depending tabs.

BRIEF DESCRIPTION OF THE DRAWINGS

Various additional features and advantages of the invention will become more apparent to those of ordinary skill in the art upon review of the following detailed description of one or more illustrative embodiments taken in conjunction with the accompanying drawings. The accompanying drawings, which are incorporated in and constitute a part of this specification, illustrate one or more embodiments of the invention and, together with the general description given above and the detailed description given below, serve to explain the one or more embodiments of the invention.

DETAILED DESCRIPTION

Figure 1:
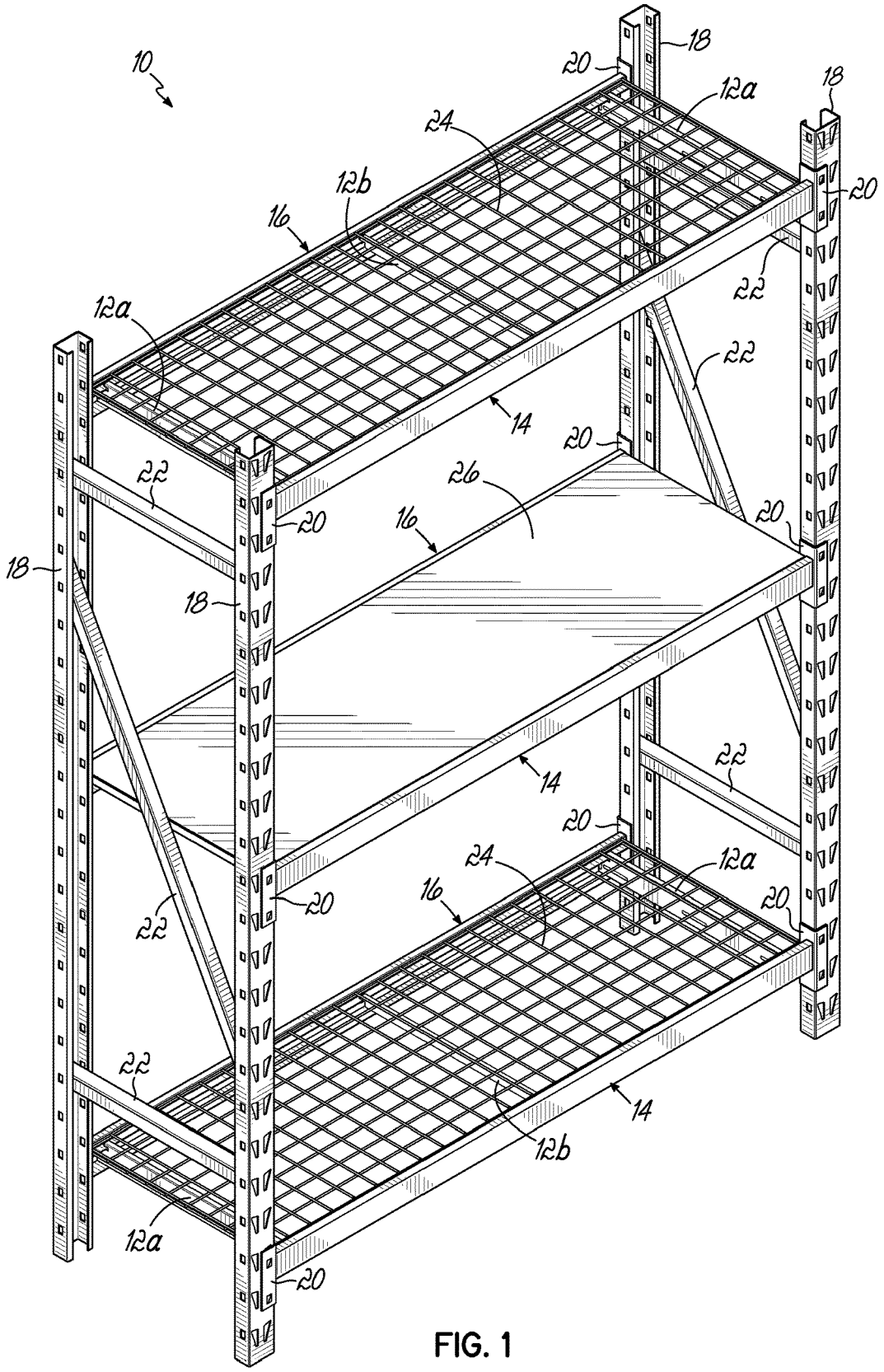
FIG. 1 is an isometric view of an exemplary shelving unit in accordance with an embodiment of the invention.
Figure 2:
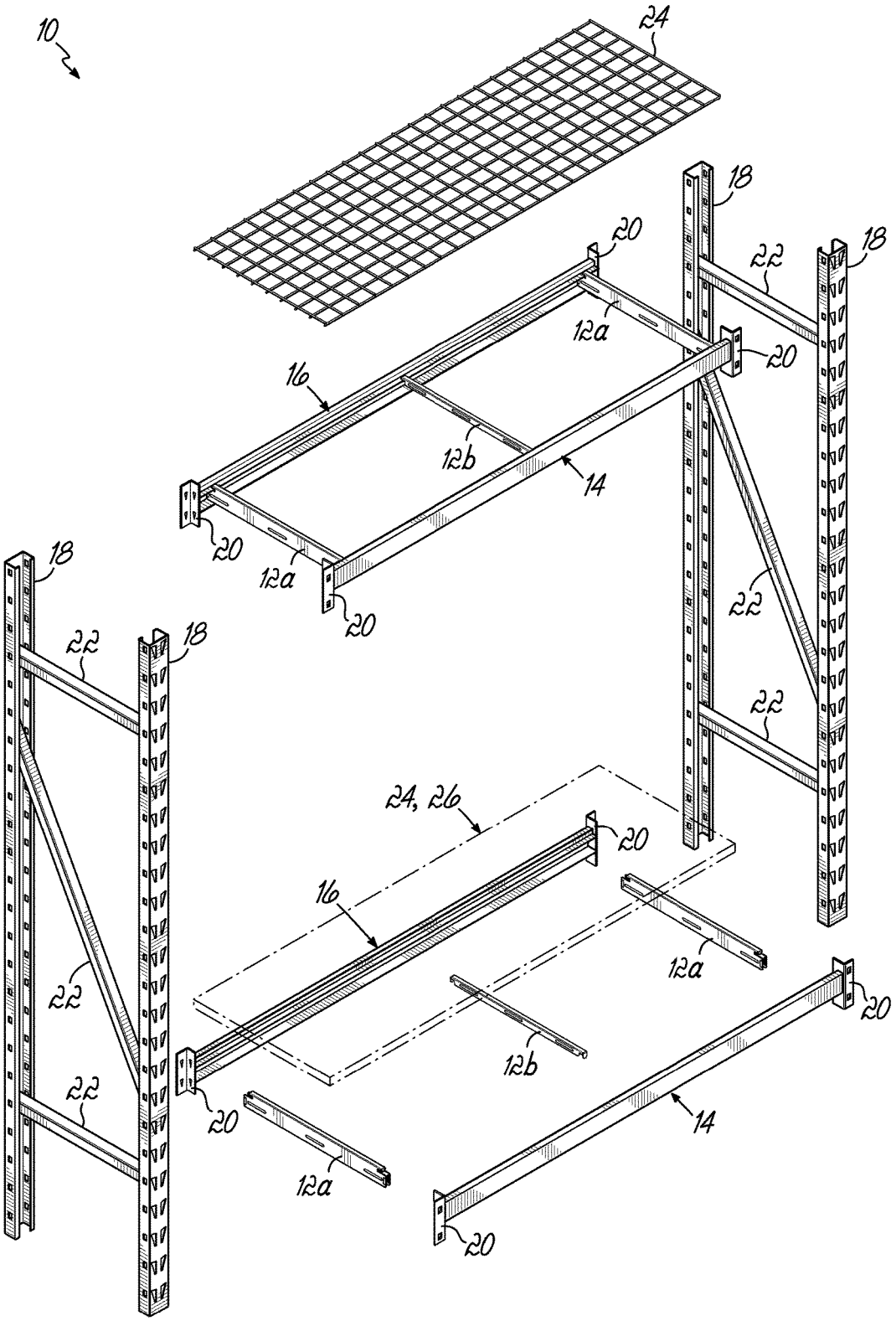
FIG. 2 is an exploded view of the shelving unit of FIG. 1.
Figure 3:
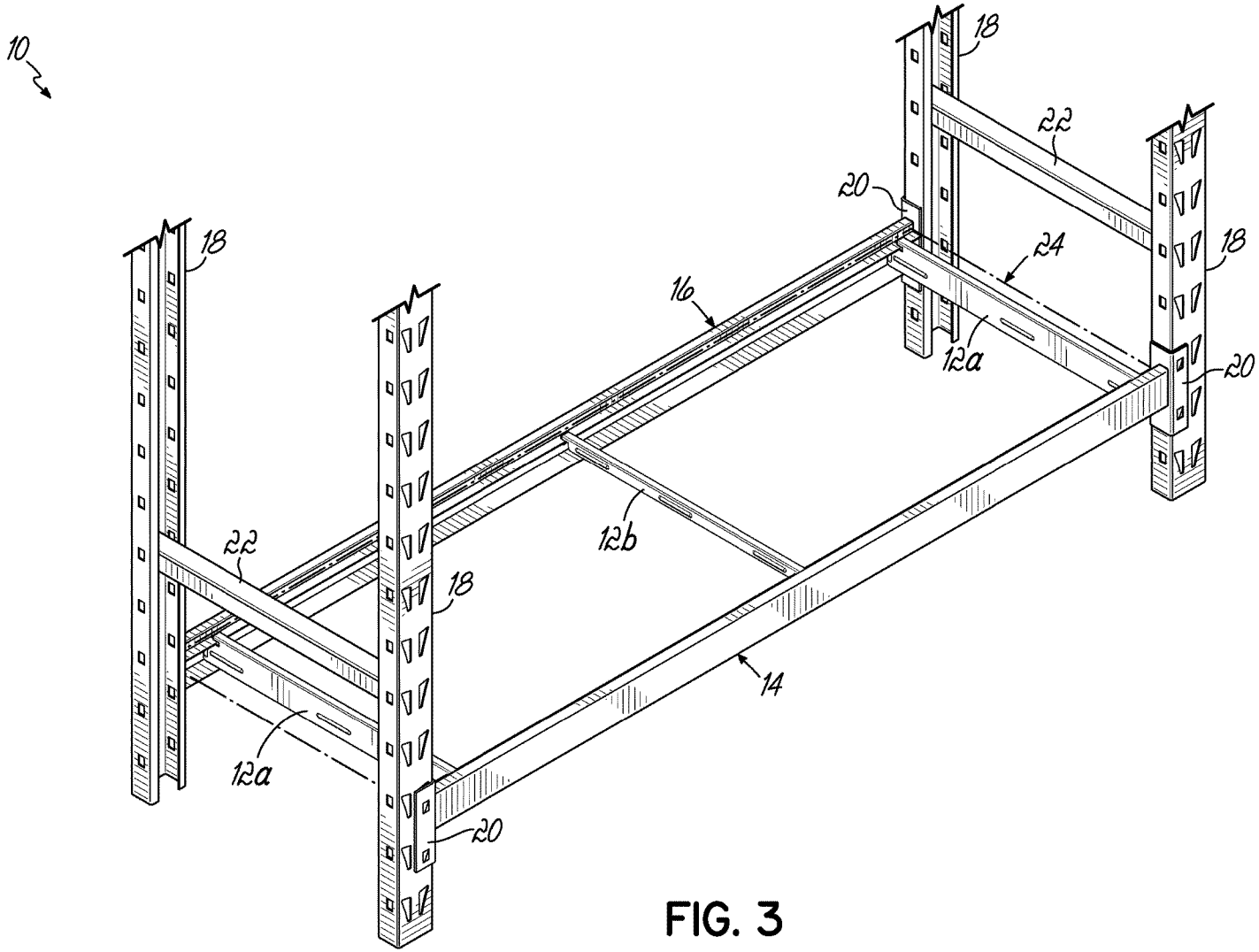
FIG. 3 is a broken isometric view of the lower end of the shelving unit of FIG. 1.

With reference to FIGS. 1-3, an exemplary shelving unit 10, which may be a steel and/or storage shelving unit, is shown in accordance with one embodiment. As set forth in further detail below, the shelving unit 10 is equipped with one or more tie members such as tie bars 12*a*, 12*b* for coupling one or more front horizontal shelf-supporting beams 14 with one or more corresponding rear horizontal shelf-supporting beams 16 for increasing the load capacity and structural integrity of the shelving unit 10. In this regard, the tie bars 12*a*, 12*b* may resist undesirable torquing or twisting of the beams 14, 16 thereby increasing the shelf-bearing capacity of the beams 14, 16 and the shelving unit 10. For example, the tie bars 12*a*, 12*b* may provide direct torque resistance to upper portions of the beams 14, 16. The features of the shelving unit 10 and tie bars 12*a*, 12*b* are set forth in further detail below to clarify each of these functional advantages and other benefits provided in this disclosure.

As shown in FIG. 1, the shelving unit 10 includes four corner posts 18 arranged in a generally rectangular configuration. The front pair of corner posts 18 cooperate to carry the front horizontal shelf supporting beams 14 via brackets 20, and the rear pair of corner posts 18 similarly cooperate to carry the rear horizontal shelf supporting beams 16 via brackets 20. The coupling of the brackets 20 to the posts 18 may be adjustable such that the number of front horizontal shelf supporting beams 14 and corresponding rear horizontal shelf supporting beams 16, and their respective heights along the posts 18, may be varied as may be desired. In the embodiment shown, the lefthand pair of corner posts 18 are coupled to each other via one or more braces 22, and the righthand pair of corner posts 18 are similarly coupled to each other via one or more braces 22. The braces 22 may contribute to the structural stability of the shelving unit 10 during use, and/or may allow the corner posts 18 to be shipped in pairs as subassemblies of the shelving unit 10 prior to final assembly of the shelving unit 10.

The illustrated shelving unit 10 includes a plurality of shelves for carrying items, including at least one horizontal wire shelf 24 and at least one horizontal solid shelf 26, each supported by a corresponding pair of front and rear horizontal shelf supporting beams 14, 16. In the embodiment shown, two horizontal wire shelves 24 and one horizontal solid shelf 26 are provided, such that a total of three pairs of front and rear horizontal shelf supporting beams 14, 16 are used. However, it will be appreciated that any number of shelves 24, 26 and corresponding front and rear horizontal shelf supporting beams 14, 16 may be used, as may be desired.

As best shown in FIGS. 2 and 3, each pair of front and rear horizontal shelf supporting beams 14, 16 is coupled together by at least one tie bar 12*a*, 12*b* for improving the structural integrity of the shelving unit 10.

Figure 4A:
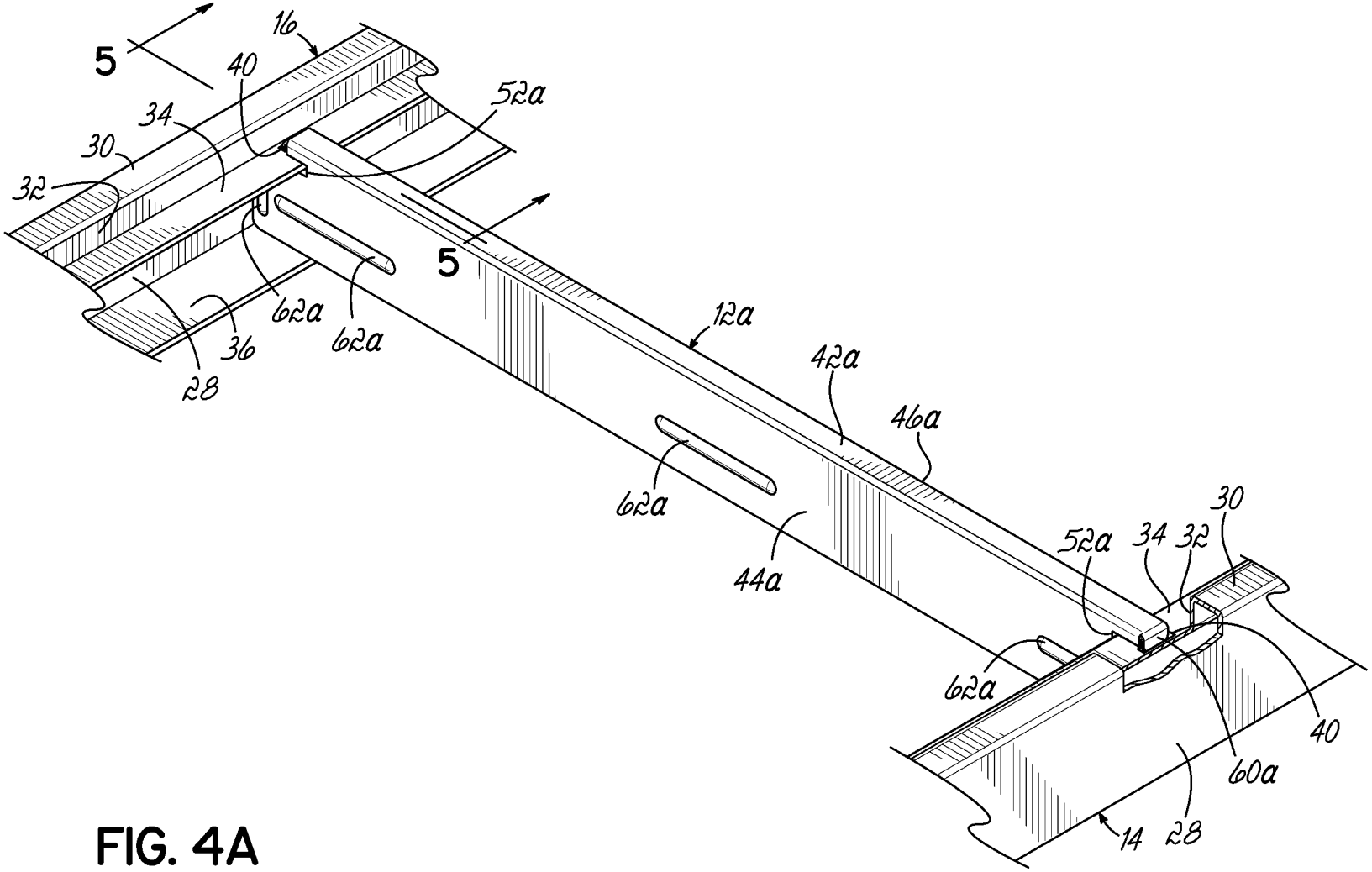
FIG. 4A is a partial isometric view of an exemplary tie bar connecting a pair of front and rear horizontal shelf-supporting beams of the shelving unit of FIG. 1.
Figure 5:
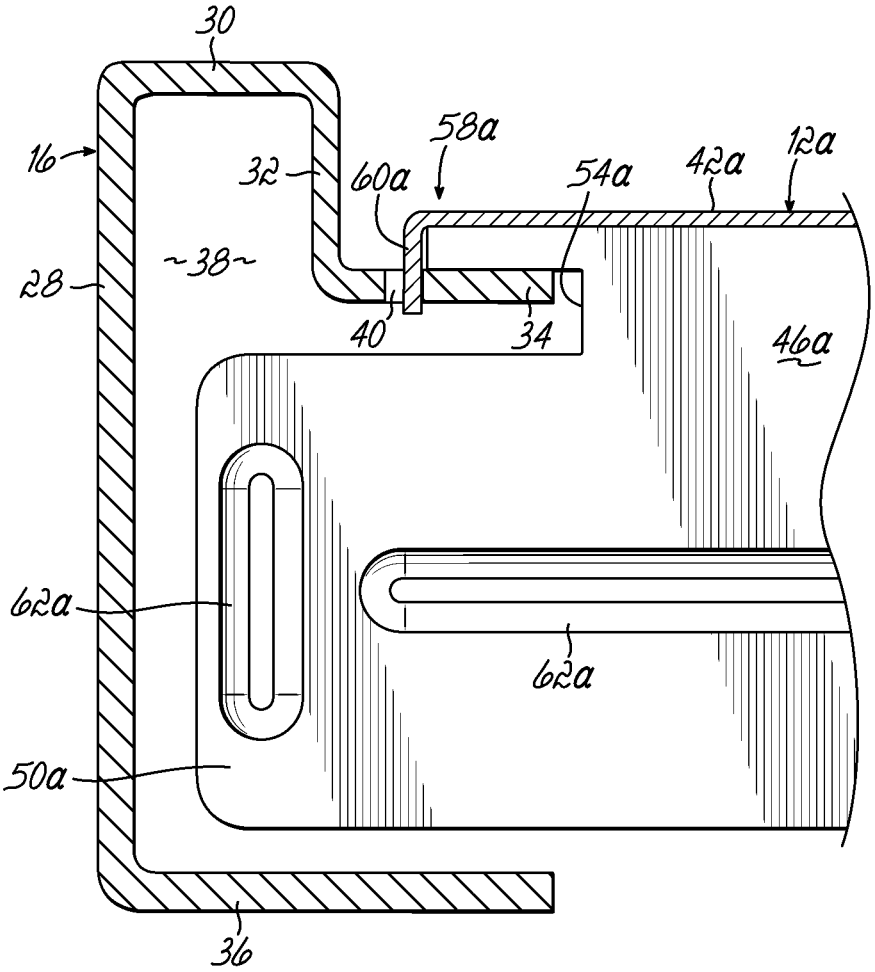
FIG. 5 is a cross-sectional view taken along section line 5-5 of FIG. 4A.

In this regard, and with reference to FIG. 4A, each beam 14, 16 may be of a generally standard construction. For example, each of the illustrated beams 14, 16 includes a vertical outer wall 28, a horizontal upper wall 30, a vertical inner wall 32, a horizontal shelf supporting flange 34, and a horizontal lower flange 36. Together, the vertical outer wall 28, horizontal upper wall 30, vertical inner wall 32, horizontal shelf supporting flange 34, and horizontal lower flange 36 define a partially enclosed interior space 38 (FIG. 5). At least one longitudinally extending slot 40 is provided in the horizontal shelf supporting flange 34 of each of the beams 14, 16, the purpose of which is discussed below.

Figure 4C:
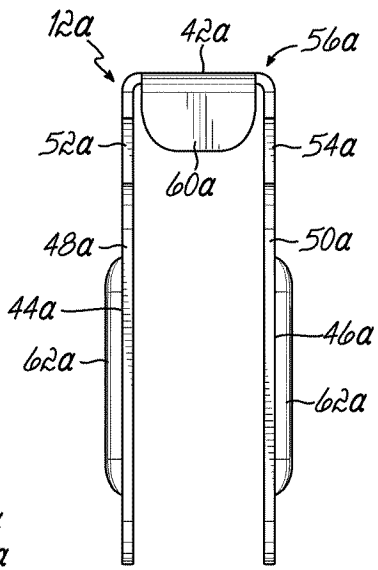
FIG. 4C is an end view of the tie bar of FIGS. 4A and 4B.

In the embodiment shown, two generally peripheral tie bars 12*a* and a single generally central tie bar 12*b* may be used to connect each pair of beams 14, 16. Referring now to FIGS. 4A-5, each of the peripheral tie bars 12*a* is an elongated member including a top wall 42*a* and first and second parallel side walls 44*a*, 46*a* extending downwardly from and perpendicular to lateral sides of the top wall 42*a* such that the tie bar 12*a* has a generally inverted U-shaped cross section (FIG. 4C). The first and second side walls 44*a*, 46*a* include respective end extensions 48*a*, 50*a* which extend longitudinally beyond the terminal ends of the top wall 42*a*. Longitudinally extending recesses 52*a*, 54*a* are provided in the side walls 44*a*, 46*a* above the end extensions 48*a*, 50*a* and extend inwardly at or near the terminal ends of the top wall 42*a*. The recesses 52*a*, 54*a* may each be of sufficient width and depth to receive a portion of the horizontal shelf supporting flange 34 of one of the beams 14, 16, as discussed below.

As shown, each peripheral tie bar 12*a* includes first and second hook elements 56*a*, 58*a* at or near respective terminal ends of the top wall 42*a*. In this embodiment, the hook elements 56*a*, 58*a* each include a depending tab 60*a* extending downwardly from the respective terminal end of the top wall 42*a* for engagement with one of the slots 40 of one of the beams 14, 16. The illustrated tabs 60*a* extend downwardly along and are narrowly spaced apart from the ends of the first and second side walls 44*a*, 46*a*. As shown, the end extensions 48*a*, 50*a* extend longitudinally beyond the respective hook elements 56*a*, 58*a* and corresponding tabs 60*a*.

In the embodiment shown, a plurality of vertically and/or horizontally extending embossments or ribs 62*a* are provided on the tie bar 12*a* for improving the stiffness and rigidity of the tie bar 12*a*. While three horizontal ribs 62*a* and two vertical ribs 62*a* are positioned on portions of each of the side walls 44*a*, 46*a*, including the end extensions 48*a*, 50*a*, of the illustrated tie bar 12*a*, it will be appreciated that any number and/or size of ribs 62*a* may positioned on any suitable portion of the tie bar 12*a* in any suitable orientation. For example, the ribs 62*a* may be positioned on surfaces different from those illustrated. It will be appreciated that the ribs 62*a* may be formed through a pressing operation or using any other suitable method of formation.

Figure 4B:
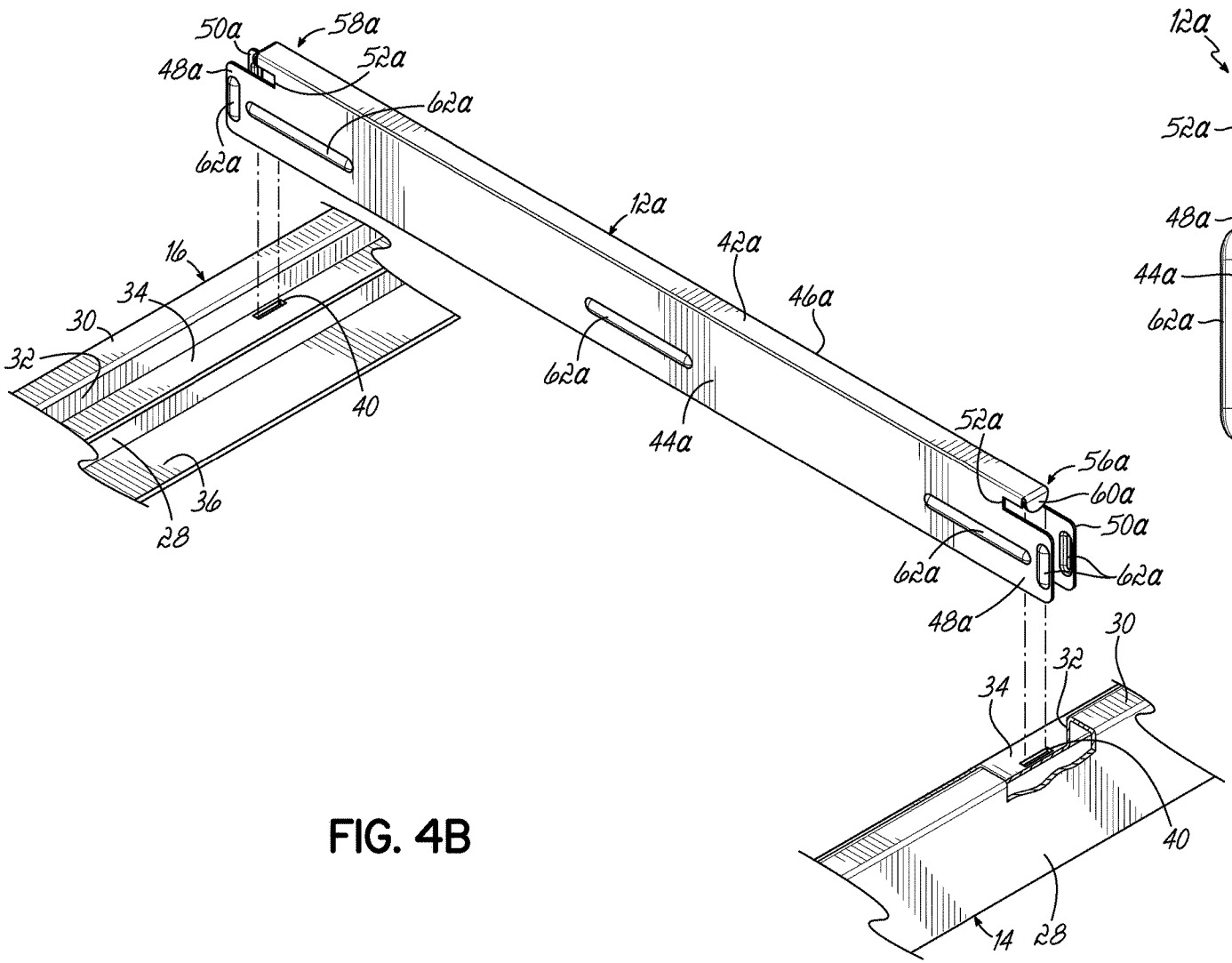
FIG. 4B is an exploded isometric view illustrating the tie bar and associated portions of the shelf-supporting beams of FIG. 4A.

As best shown in FIGS. 4A, 4B, and 5, in use, the tabs 60*a* of the hook elements 56*a*, 58*a* are inserted into and received by the corresponding slots 40 of the respective front and rear beams 14, 16. When the tabs 60*a* are received by the slots 40, at least a portion of the top wall 42*a* and/or side walls 44*a*, 46*a* may rest on, and be supported by, the corresponding horizontal shelf supporting flange 34. In the embodiment shown, each beam 14, 16 includes three slots 40, wherein each slot 40 of the front beam 14 is configured to be positioned opposite a corresponding slot 40 of the rear beam 16 when in use so that the tabs 60*a* of each tie bar 12*a* may be selectively inserted into opposing slots 40 of a pair of front and rear beams 14, 16 to connect the front and rear beams 14, 16 and improve the structural integrity of the shelving unit 10. The positioning of each tie bar 12*a* along the respective front and rear beams 14, 16 may be selected based on the locations of the slots 40 therealong. In this regard, any number of slots 40 may be provided on the beams 14, 16 at any desirable locations for providing various options for positioning one or more tie bars 12*a*. For example, while the illustrated tie bars 12*a* are shown and described as being positioned at or near the peripheral ends of the respective beams 14, 16, it will be appreciated that the tie bars 12*a* may be positioned more centrally along the respective beams 14, 16.

As best shown in FIG. 5, when each tab 60*a* is received in the respective slot 40, a portion of the corresponding horizontal shelf supporting flange 34 is received by the recess 52*a*, 54*a* in the respective side wall 44*a*, 46*a* of the tie bar 12*a*. In this manner, the recesses 52*a*, 54*a* may accommodate the horizontal shelf supporting flanges 34 such that the side walls 44*a*, 46*a* of the tie bar 12*a* may avoid interfering with the insertion of the tabs 60*a* in the respective slots 40. Moreover, when each tab 60*a* is received in the respective slot 40, the corresponding end extensions 48*a*, 50*a* of the side walls 44*a*, 46*a* are received in the interior space 38 of the respective beam 14, 16. This configuration may improve the securement of the tie bar 12*a* to the respective beams 14, 16 and/or improve the structural integrity of the shelving unit 10. For example, engagement between either of the end extensions 48*a*, 50*a* and the respective horizontal shelf supporting flange 34 may limit undesirable bowing of the tie bar 12*a*. In addition or alternatively, the end extensions 48*a*, 50*a* may aid in rigidifying the tie bar 12*a* at or near the various interfaces with the beams 14, 16.

Figure 6A:
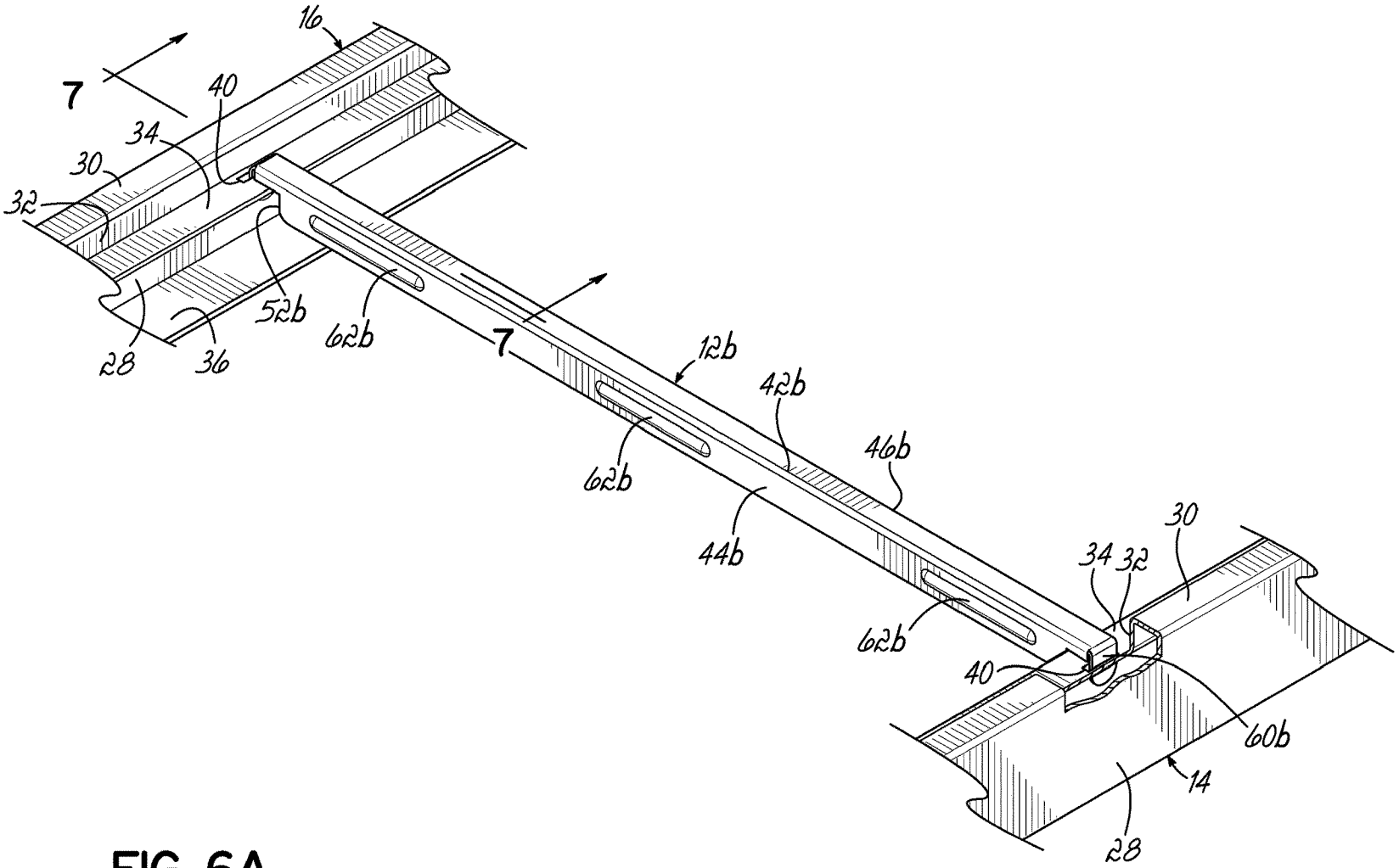
FIG. 6A is a partial isometric view of another exemplary tie bar connecting a pair of front and rear horizontal shelf-supporting beams of the shelving unit of FIG. 1.
Figure 6C:
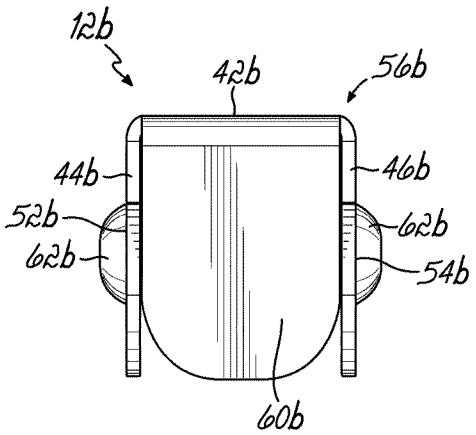
FIG. 6C is an end view of the tie bar of FIGS. 6A and 6B.
Figure 6B:
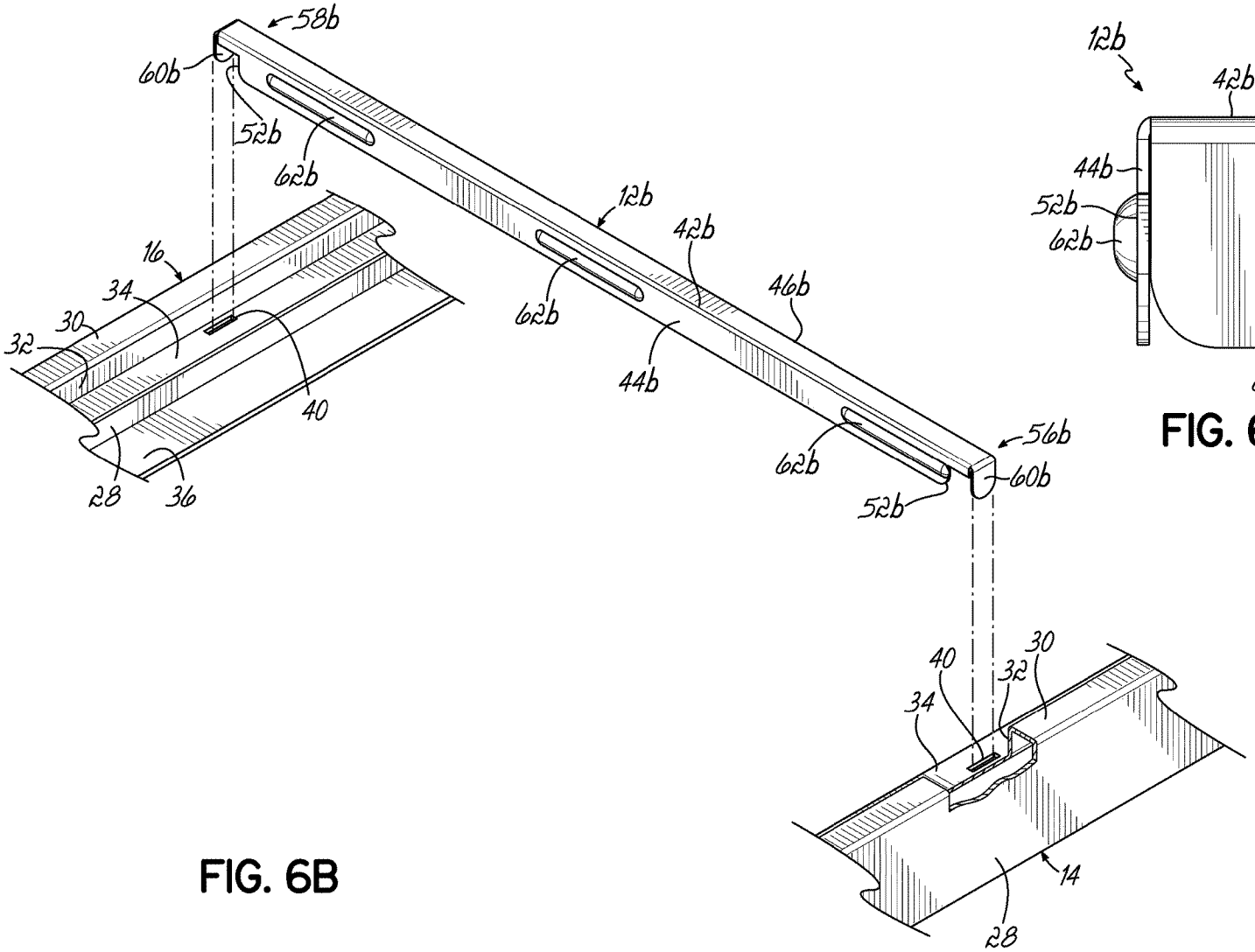
FIG. 6B is an exploded isometric view illustrating the tie bar and associated portions of the shelf-supporting beams of FIG. 6A.
Figure 7:
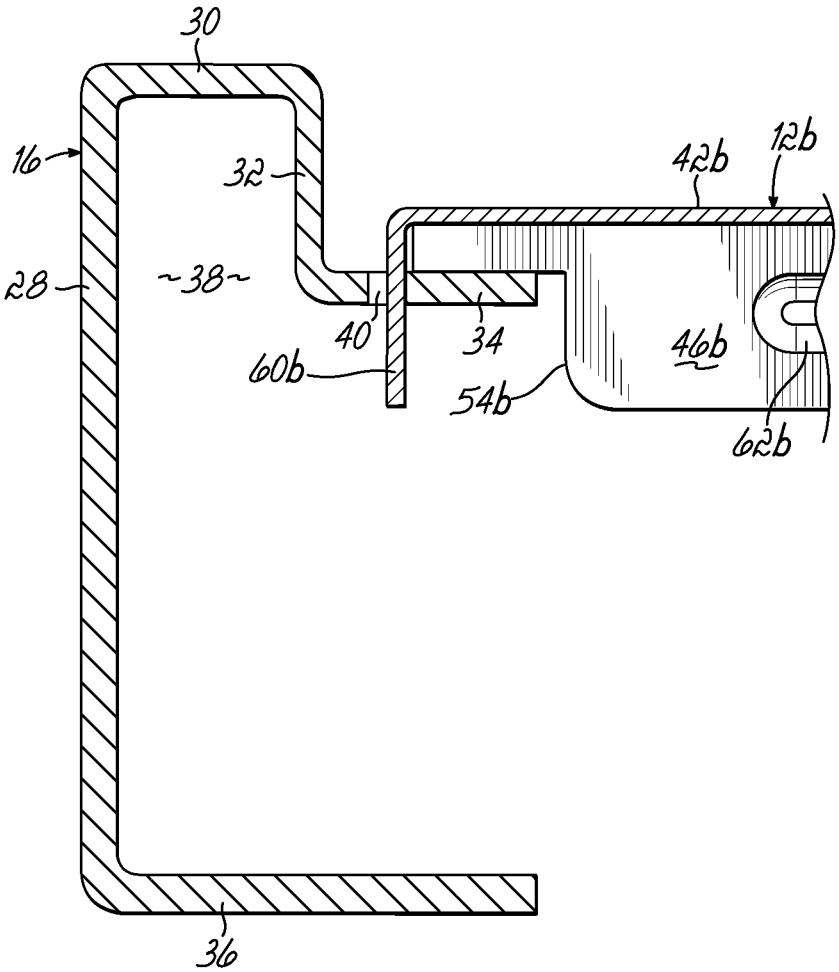
FIG. 7 is a cross-sectional view taken along section line 7-7 of FIG. 6A.

Referring now to FIGS. 6A-7, wherein like numerals represent like features, the central tie bar 12*b* is an elongated member including a top wall 42*b* and first and second parallel side walls 44*b*, 46*b* extending downwardly from and perpendicular to lateral sides of the top wall 42*b* such that the tie bar 12*b* has a generally inverted U-shaped cross section (FIG. 6C). Recesses 52*b*, 54*b* are provided in the side walls 44*b*, 46*b* and extend inwardly at or near the terminal ends of the top wall 42*b*. The recesses 52*b*, 54*b* may each be of sufficient width and depth to receive a portion of the horizontal shelf supporting flange 34 of one of the beams 14, 16, as discussed below.

As shown, the central tie bar 12*b* includes first and second hook elements 56*b*, 58*b* at or near respective terminal ends of the top wall 42*b*. In this embodiment, the hook elements 56*b*, 58*b* each include a depending tab 60*b* extending downwardly from the respective terminal end of the top wall

42*b* for engagement with one of the slots 40 of one of the beams 14, 16. The illustrated tabs 60*b* extend downwardly along and are narrowly spaced apart from the ends of the first and second side walls 42*b*, 44*b*.

In the embodiment shown, a plurality of vertically and/or horizontally extending embossments or ribs 62*b* are provided on the tie bar 12*b* for improving the stiffness and rigidity of the tie bar 12*b*. While three horizontal ribs 62*b* are positioned on portions of each of the side walls 44*b*, 46*b* of the illustrated tie bar 12*b*, it will be appreciated that any number and/or size of ribs 62*b* may positioned on any suitable portion of the tie bar 12*b* in any suitable orientation. For example, the ribs 62*b* may be positioned on surfaces different from those illustrated. It will be appreciated that the ribs 62*b* may be formed through a pressing operation or using any other suitable method of formation.

Similar to the tabs 60 of the peripheral tie bars 12*a*, and as best shown in FIGS. 6A, 6B, and 7, in use, the tabs 60*b* of the hook elements 56*b*, 58*b* are inserted into and received by the corresponding slots 40 of the respective front and rear beams 14, 16. When the tabs 60*b* are received by the slots 40, at least a portion of the top wall 42*b* and/or side walls 44*b*, 46*b* may rest on, and be supported by, the corresponding horizontal shelf supporting flange 34. The tabs 60 of the tie bar 12*b* may be selectively inserted into opposing slots 40 of a pair of front and rear beams 14, 16 to connect the front and rear beams 14, 16 and improve the structural integrity of the shelving unit 10, in a manner similar to that described above with respect to the peripheral tie bars 12*a*. While the illustrated tie bar 12*b* is shown and described as being positioned at or near the longitudinal center point of the respective beams 14, 16, it will be appreciated that the tie bar 12*b* may be positioned more peripherally along the respective beams 14, 16.

As best shown in FIG. 6A, when each tab 60*b* is received in the respective slot 40, a portion of the corresponding horizontal shelf supporting flange 34 is received by the recess 52*b*, 54*b* in the respective side wall 44*b*, 46*b* of the tie bar 12*b*. In this manner, the recesses 52*b*, 54*b* may accommodate the horizontal shelf supporting flanges 34 such that the side walls 44*b*, 46*b* of the tie bar 12*b* may avoid interfering with the insertion of the tabs 60*b* in the respective slots 40.

In the embodiment shown, the same slots 40 on the beams 14, 16 may be used for attaching either of the illustrated tie bars 12*a*, 12*b* thereto. In other embodiments, dedicated slots (not shown) may be provided for each of the different configurations of tie bars 12*a*, 12*b*.

Figure 8A:
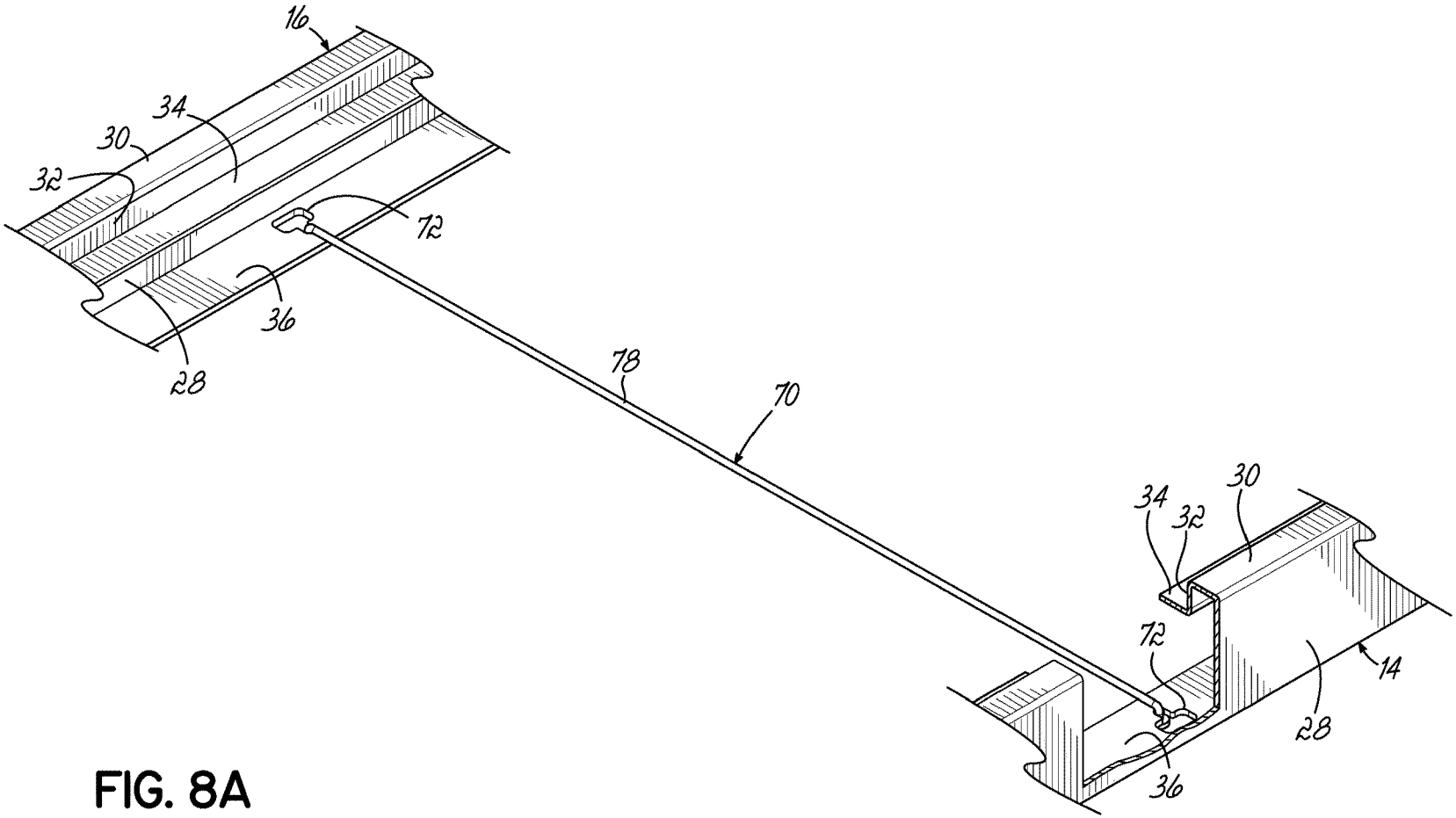
FIG. 8A is a partial isometric view of an exemplary tie rod connecting a pair of front and rear horizontal shelf-supporting beams of the shelving unit of FIG. 1.
Figure 8B:
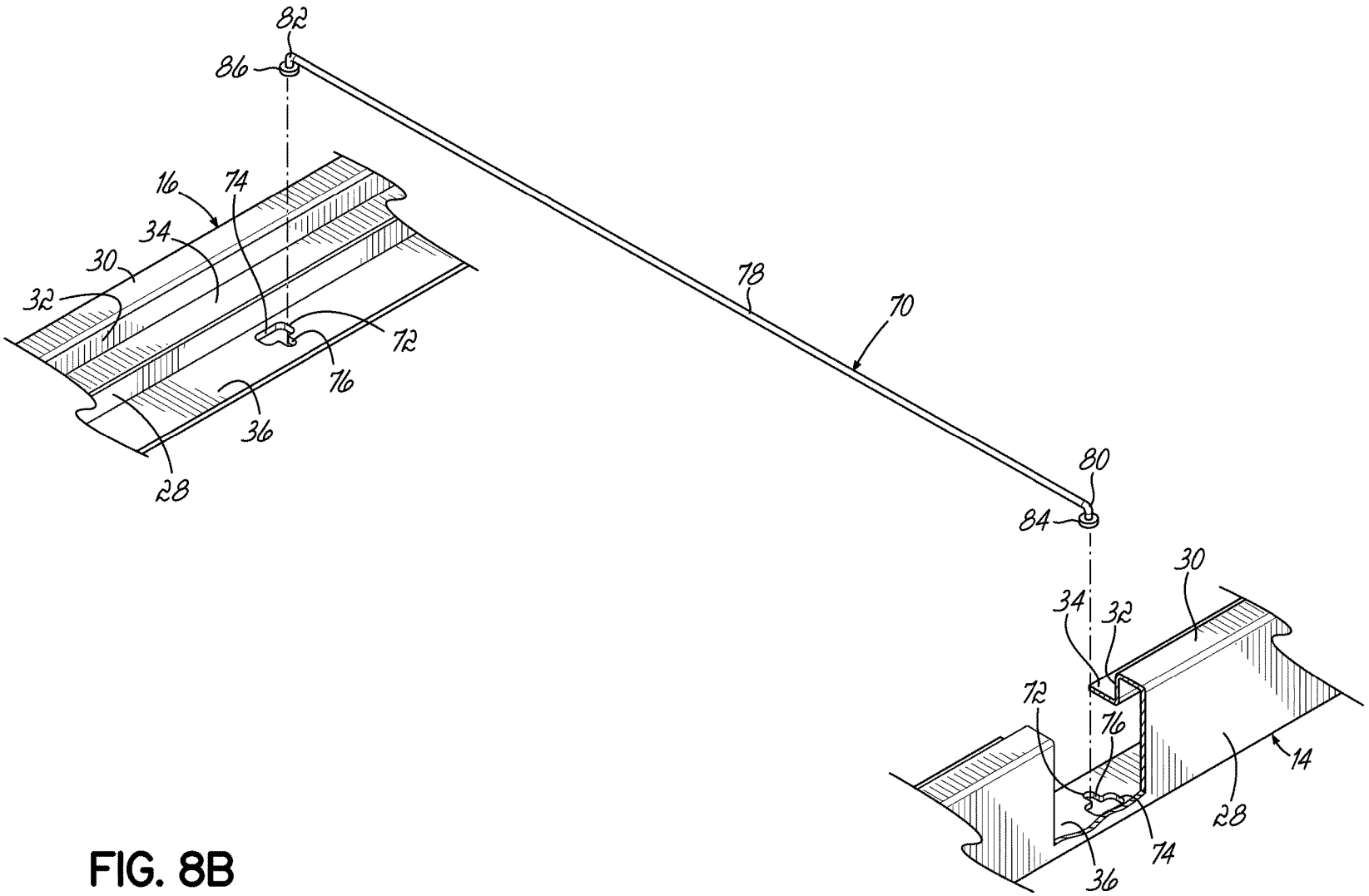
FIG. 8B is an exploded isometric view illustrating the tie rod and associated portions of the shelf-supporting beams of FIG. 8A.

Referring now to FIGS. 8A and 8B, each pair of front and rear horizontal shelf supporting beams 14, 16 may be coupled together by at least one tie rod 70 for improving the structural integrity of the shelving unit 10.

In this regard, each beam 14, 16 may include at least one aperture such as a tapered aperture or keyhole 72 provided in the horizontal lower flange 36. In the embodiment shown, the keyhole 72 includes a large portion 74 and a small portion 76, the purposes of which are discussed below.

In the embodiment shown, the tie rod 70 includes an elongated body 78 having downwardly angled end portions 80, 82 terminating in radially enlarged portions 84, 86. In one embodiment, the downwardly angled end portions 80, 82 may be at an angle of approximately 90° relative to the elongated body 78. The radially enlarged portions 84, 86 may each be of sufficiently small width to pass vertically through the large portions 74 of the keyholes 72, and of sufficiently large width to be unable to pass vertically through the small portions 76 of the keyholes 72, as discussed below.

In use, the radially enlarged portions 84, 86 of the tie rod 70 are inserted into and received by the large portions 74 of the corresponding keyholes 72 of the respective front and rear beams 14, 16. The radially enlarged portions 84, 86 may then be moved below the respective small portions 76 of the keyholes 72 in order to lock the tie rod 70 in place. In this regard, the tie rod 70 may be constructed of a sufficiently flexible material to allow manipulation of the end portions 80, 82 for positioning the radially enlarged portions 84, 86. Each beam 14, 16 may include any number of keyholes 72, wherein each keyhole 72 of the front beam 14 is configured to be positioned opposite a corresponding keyhole 72 of the rear beam 16 when in use so that the radially enlarged portions 84, 86 of the tie rod 70 may be selectively inserted into opposing keyholes 72 of a pair of front and rear beams 14, 16 to connect the front and rear beams 14, 16 and resist motion of the lower portions of the beams 14, 16 away from each other to avoid undesirable outward twisting of the lower portions of the beams 14, 16. The positioning of the tie rod 70 along the respective front and rear beams 14, 16 may be selected based on the locations of the keyholes 72 therealong. For example, the keyholes 72 may be configured so that one or more tie rods 70 may be positioned below and/or longitudinally offset from any of the tie bars 12*a*, 12*b* along the respective beams 14, 16.

Figure 9A:
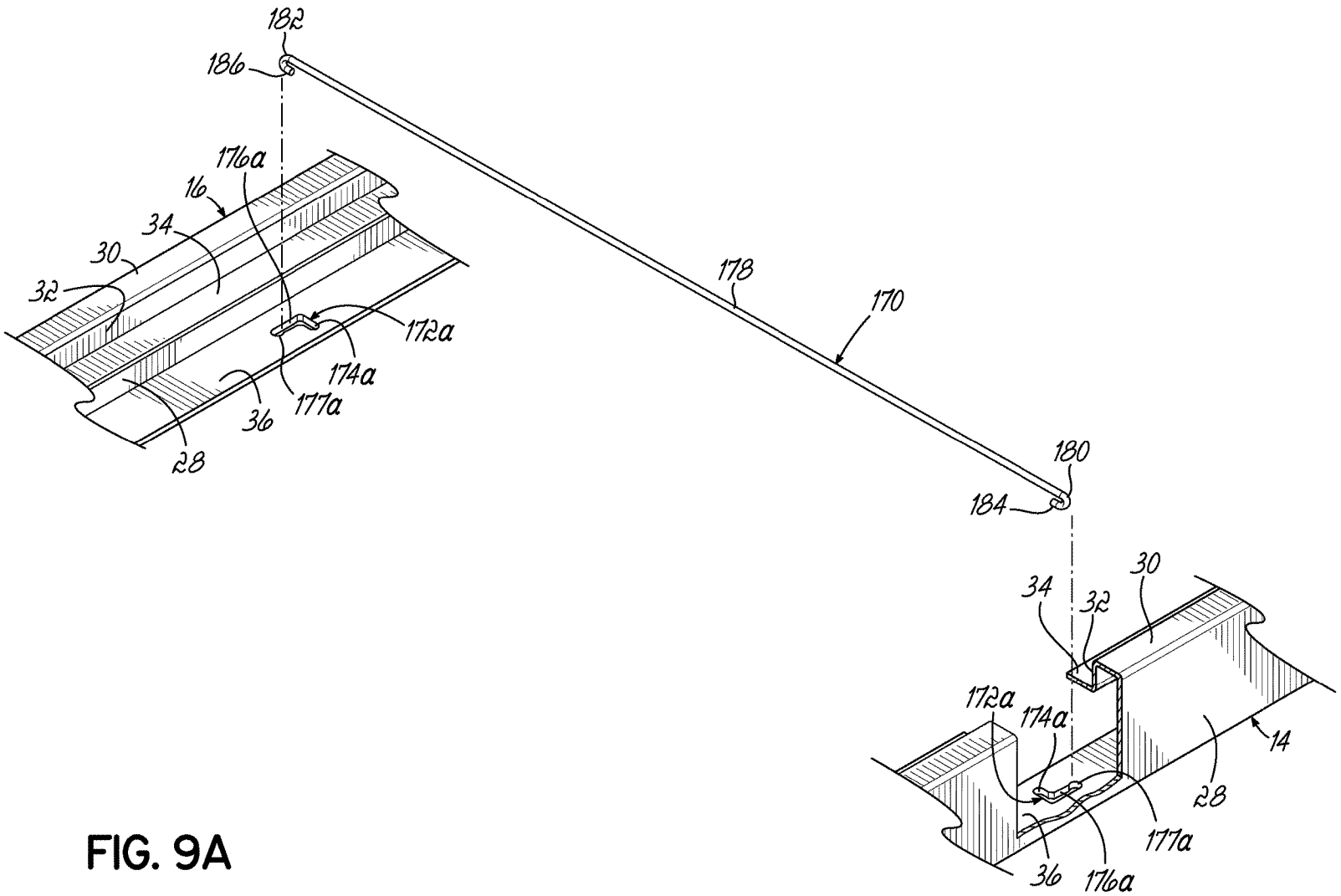
FIG. 9A is an exploded isometric view of another exemplary tie rod connecting a pair of front and rear horizontal shelf-supporting beams of the shelving unit of FIG. 1.
Figure 9B:
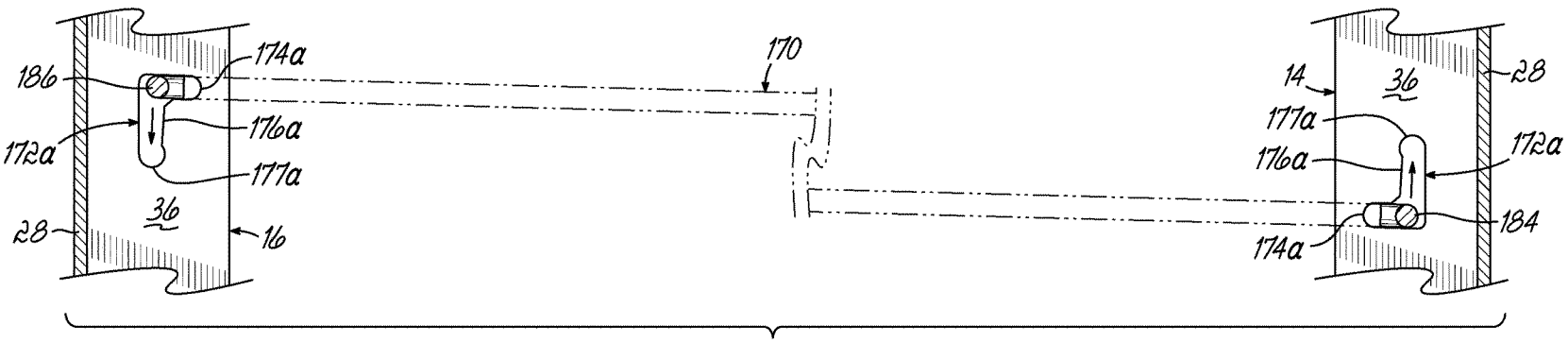
FIGS. 9B and 9C are partial top plan views illustrating the connection of the tie rod shown in FIG. 9A to the horizontal beams.
Figure 9C:
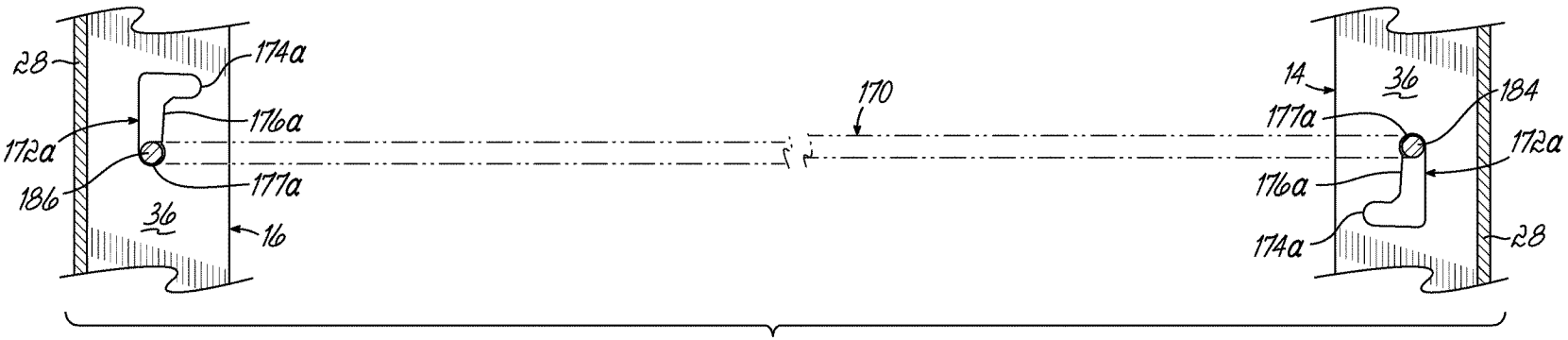

Referring now to FIGS. 9A-9C, wherein like numerals represent like features, an alternative tie rod 170 may be used for coupling each pair of front and rear horizontal shelf supporting beams 14, 16 for improving the structural integrity of the shelving unit 10.

In this regard, each beam 14, 16 may include at least one aperture such as an L-shaped aperture 172*a* provided in the horizontal lower flange 36. In the embodiment shown, the aperture 172*a* includes a laterally extending leg 174*a* and a longitudinally extending leg 176*a* which terminates in a notch 177*a*, the purposes of which are discussed below.

In the embodiment shown, the tie rod 170 includes an elongated body 178 having downwardly curved end portions 180, 182 terminating in J-shaped hook portions 184, 186. In one embodiment, the J-shaped hook portions 184, 186 may define an approximately 360° turn relative to the elongated body 78. The J-shaped hook portions 184, 186 may each be of sufficiently small width and length to pass vertically through the lateral legs 174*a* of the apertures 172*a*, and of sufficiently large length to be unable to pass vertically through the notches 177*a* of the apertures 172*a*, as discussed below.

In use, the J-shaped hook portions 184, 186 of the tie rod 170 are inserted into and received by the lateral legs 174*a* of the corresponding apertures 172*a* of the respective front and rear beams 14, 16 (FIG. 9B). The J-shaped hook portions 184, 186 may then be moved below the respective longitudinal legs 176*a* of the apertures 172*a* to the respective notches 177*a* (FIG. 9C). The J-shaped hook portions 184, 186 and notches 177*a* may be relatively sized to provide a snap-fit therebetween for locking the tie rod 170 in place. As best shown in FIG. 9B, the illustrated tie rod 170 may be angled or canted to position the J-shaped hook portions 184, 186 in the respective notches 177*a*. Each beam 14, 16 may include any number of apertures 172*a*, wherein each aperture 172*a* of the front beam 14 is configured to be positioned opposite a corresponding aperture 172*a* of the rear beam 16 when in use so that the J-shaped hook portions 184, 186 of each tie rod 170 may be selectively inserted into opposing apertures 172*a* of a pair of front and rear beams 14, 16 to connect the front and rear beams 14, 16 and resist motion of the lower portions of the beams 14, 16 away from each other to avoid undesirable outward twisting of the lower portions of the beams 14, 16. In the embodiment shown, each aperture 172*a* of the front beam 14 is configured to be inverted relative to the corresponding aperture 172*a* of the rear beam 16 and to be slightly longitudinally offset relative thereto. More particularly, the lateral leg 174*a* and notch 177*a* of the front beam 14 are arranged on opposite ends of the longitudinal leg 176*a* relative to the corresponding lateral leg 174*a* and notch 177*a* of the rear beam 16. The notch 177*a* of the front beam 14 is also configured to be opposite the notch 177*a* of the rear beam 16 such that, when the tie rod 170 is canted to position the J-shaped hook portions 184, 186 in the respective notches 177*a*, the tie rod 170 may be substantially perpendicular to each of the front and rear beams 14, 16. The positioning of each tie rod 170 along the respective front and rear beams 14, 16 may be selected based on the locations of the apertures 172*a* therealong. For example, the apertures 172*a* may be configured so that one or more tie rods 170 may be positioned below and/or longitudinally offset from any of the tie bars 12*a*, 12*b* along the respective beams 14, 16.

Figure 10A:
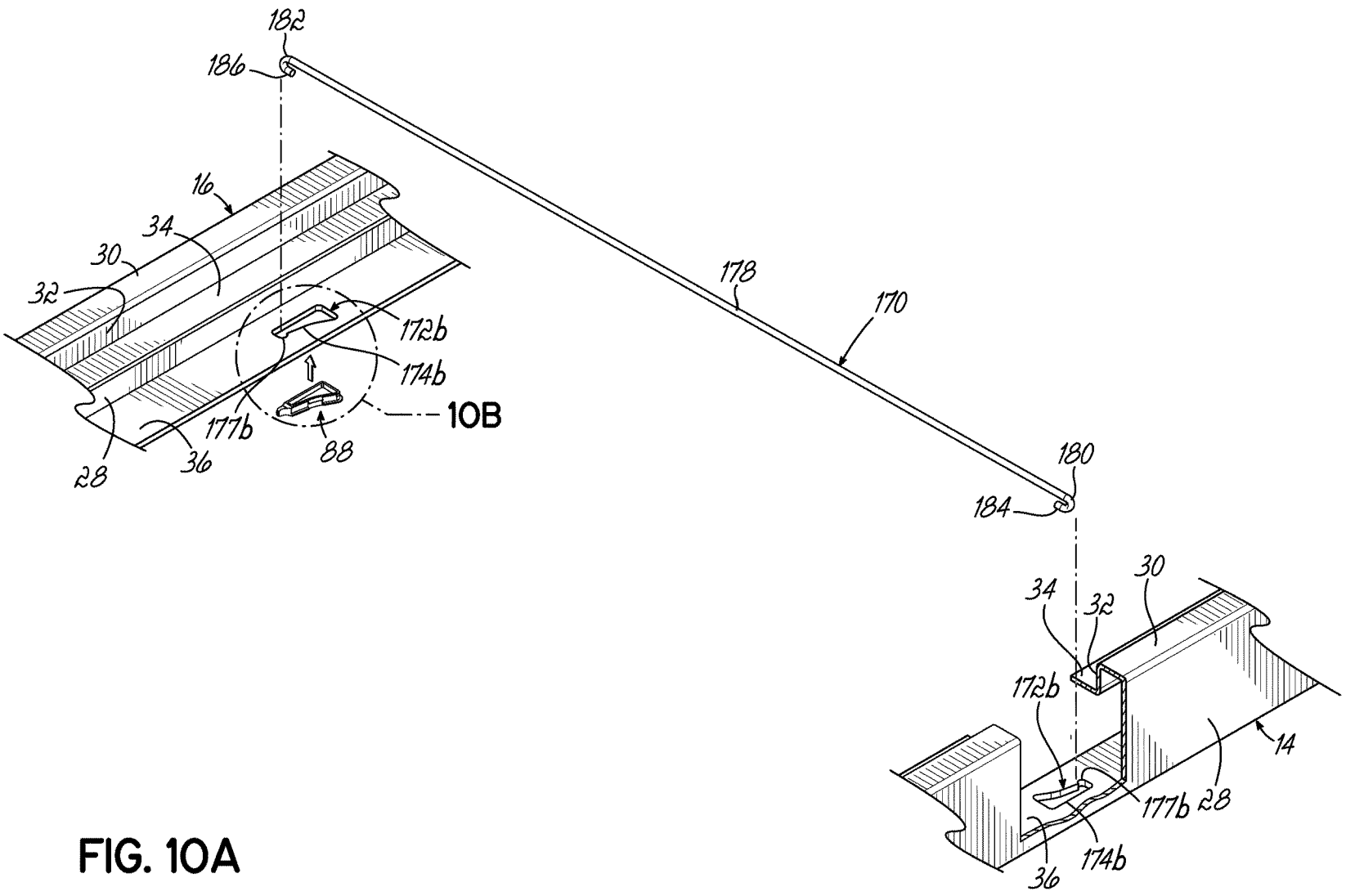
FIG. 10A is an exploded isometric view similar to FIG. 9A illustrating an alternative connection of the tie rod to the horizontal beams.
Figure 10C:
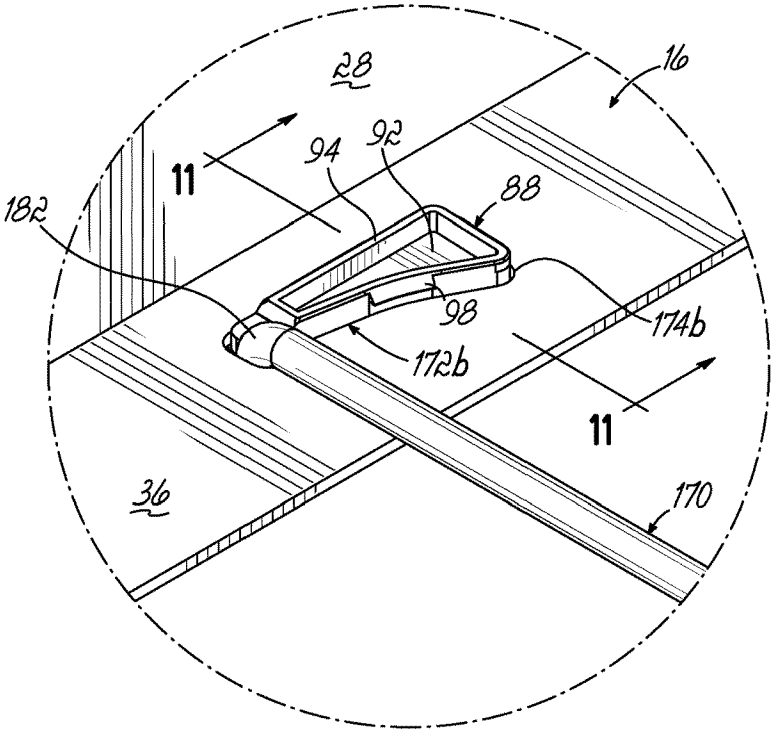
FIGS. 10B and 10C are magnified isometric views illustrating the connection to the tie rod shown in FIG. 10A to one of the horizontal beams and the insertion of a plug.
Figure 10B:
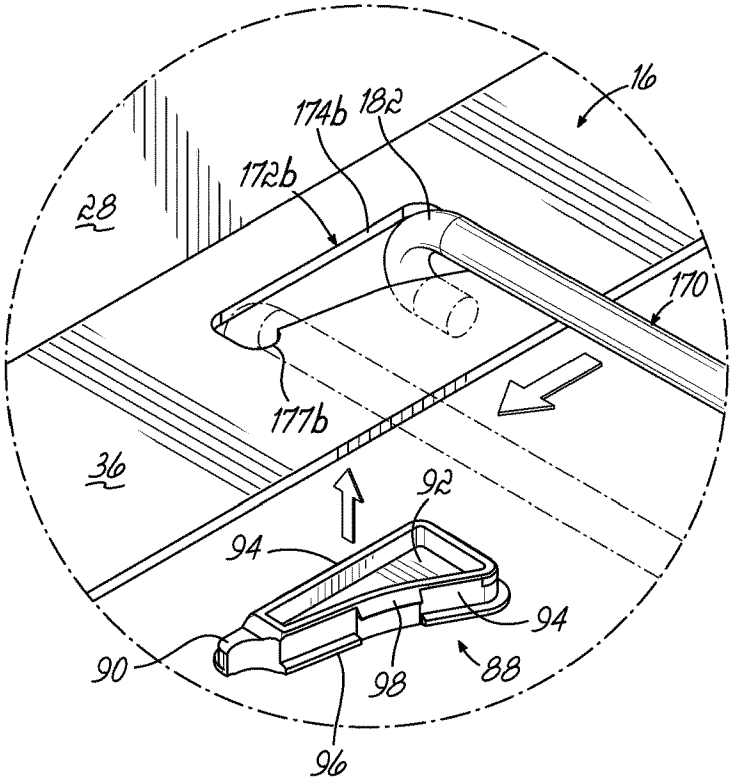
Figure 11:
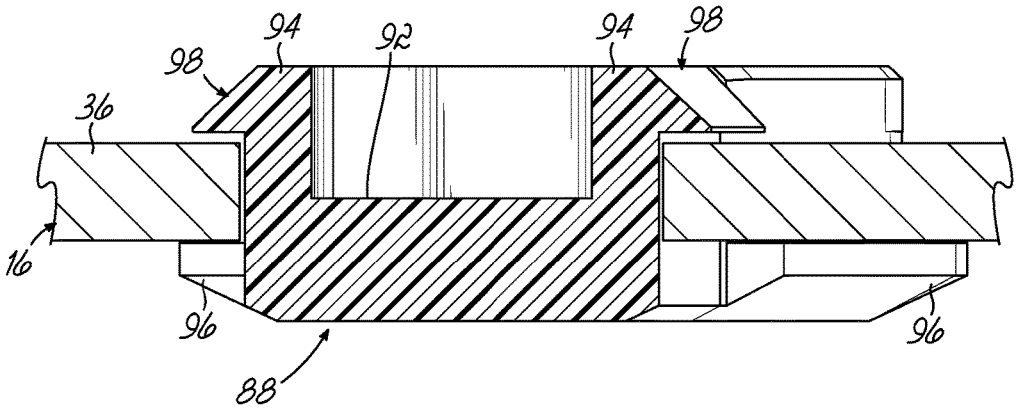
FIG. 11 is a cross-sectional view taken along section line 11-11 of FIG. 10C.

Referring now to FIGS. 10A-11, each beam 14, 16 may include at least one trapezoidal aperture 172*b* provided in the horizontal lower flange 36 for receiving a corresponding J-shaped hook portion 184, 186 of the tie rod 170. In the embodiment shown, the aperture 172*b* includes a large portion 174*b* which tapers laterally inwardly toward a notch 177*b*, the purposes of which are discussed below.

In use, the J-shaped hook portions 184, 186 of the tie rod 170 are inserted into and received by the large portions 174*b* of the corresponding apertures 172*b* of the respective front and rear beams 14, 16 (FIG. 10B). The J-shaped hook portions 184, 186 may then be moved below the large portions 174*b* of the apertures 172*b* to the respective notches 177*b* (FIG. 10C). The J-shaped hook portions 184, 186 and notches 177*b* may be relatively sized to provide a snap-fit therebetween for locking the tie rod 170 in place. The tie rod 170 may be angled or canted to position the J-shaped hook portions 184, 186 in the respective notches 177*b*. Each beam 14, 16 may include any number of apertures 172*b*, wherein each aperture 172*b* of the front beam 14 is configured to be positioned opposite a corresponding aperture 172*b* of the rear beam 16 when in use so that the J-shaped hook portions 184, 186 of each tie rod 170 may be selectively inserted into opposing apertures 172*b* of a pair of front and rear beams 14, 16 to connect the front and rear beams 14, 16 and resist motion of the lower portions of the beams 14, 16 away from each other to avoid undesirable outward twisting of the lower portions of the beams 14, 16. In the embodiment shown, each aperture 172*b* of the front beam 14 is configured to be inverted relative to the corresponding aperture 172*b* of the rear beam 16 and to be slightly offset relative thereto. More particularly, the notch 177*b* of the front beam 14 is arranged on an opposite end of the large portion 174*b* relative to the corresponding notch 177*b* of the rear beam 16, and the large portion 174*b* of the front beam 14 tapers in the opposite direction relative to the corresponding large portion 174*b* of the rear beam 16. The notch 177*b* of the front beam 14 is also configured to be opposite the notch 177*b* of the rear beam 16 such that, when the tie rod 170 is canted to position the J-shaped hook portions 184, 186 in the respective notches 177*b*, the tie rod 170 may be substantially perpendicular to each of the front and rear beams 14, 16. The positioning of each tie rod 170 along the respective front and rear beams 14, 16 may be selected based on the locations of the apertures 172*b* therealong. For example, the apertures 172*b* may be configured so that one or more tie rods 170 may be positioned below and/or longitudinally offset from any of the tie bars 12*a*, 12*b* along the respective beams 14, 16.

In the embodiment shown, a plug 88 may be selectively and removably positioned in the aperture 172*b* to further secure the corresponding J-shaped hook portion 184, 186 in place and thereby assist in preventing unintentional dislodgment of the tie rod 170. To this end, the illustrated plug 88 is constructed of a resilient material and is sized and shaped to provide an interference fit with at least a portion of the aperture 172*b*. For example, the plug 88 may be generally trapezoidal for providing an interference fit with the large portion 174*b* of the aperture 172*b*, and may include an at least partially curved finger extension 90 configured to be received in the notch 177*b* and to engage the end 180, 182 of the tie rod 170 when the J-shaped hook portion 184, 186 is snapped in place in the notch 177*b*. The illustrated plug 88 includes a trapezoidal base 92 and a plurality of walls 94 extending upwardly therefrom. A flange 96 extends around at least a portion of the lower periphery of the plug 88 for engaging a bottom surface of the lower horizontal flange 36 of the respective beam 14, 16. While the illustrated flange 96 is discontinuous or interrupted, it will be appreciated that the flange 96 may alternatively extend continuously around the entire lower periphery of the plug 88. In the embodiment shown, the plug 88 further includes a flexible tab 98 positioned at or near an upper end of one of the walls 94.

In use, each plug 88 may be aligned below the respective aperture 172*b* after the J-shaped hook portion 184, 186 has been properly positioned in the corresponding notch 177*b*, and may then be moved upwardly into the apertures 172*b*, as shown in FIGS. 10B and 10C. As the plug 88 is inserted into the aperture 172*b*, the tab 98 may contact the bottom surface of the lower horizontal flange 36 and may be flexed thereby from a natural state to a flexed state. In this regard, the tab 98 may include an angled upper surface configured to encourage such flexing. As the plug 88 is further inserted, the flexible tab 98 may pass through the aperture 172*b* and return to its natural, non-flexed state. As best shown in FIG. 11, in this position the flexible tab 98 may be in abutment with and/or adjacent to an upper surface of the lower horizontal flange 36 of the beam 14, 16 and the flange 96 may be in abutment with and/or adjacent to the lower surface of the lower horizontal flange 36 of the beam 14, 16. In this manner, the lower horizontal flange 36 of the beam 14, 16 may be at least partially sandwiched between the flange 96 and the tab 98 in order to assist in preventing the plug 88 from becoming dislodged. Moreover, the curved surface of the finger extension 90 may be in abutment with and/or adjacent to the respective end 180, 182 of the tie rod 170 so as to limit and/or prohibit movement of the end 180, 182 of the rod 170 in a direction away from the notch 177*b*. As shown in FIG. 10C, the plug 88 may at least partially conceal the respective aperture 172*b*.

Each plug 88 may be selectively removed from the aperture 172*b* to facilitate removal of the corresponding tie rod 170, such as during disassembly of the shelving unit 10 or rearrangement of the tie rod 170. To this end, the flexible tab 98 of the plug 88 may be depressed to a flexed state to allow the plug 88 to pass downwardly through the respective aperture 172*b* and thereby release the plug 88. The tie rod 170 may then be canted to position the hook portions 184, 186 in the large portions 174*b* of the apertures 172*b* thereby allowing the hook portions 184, 186 to be easily removed from the apertures 172*b* for removal and/or repositioning of the tie rod 170 at another location along the same or different pair of beams 14, 16.

Figure 12A:
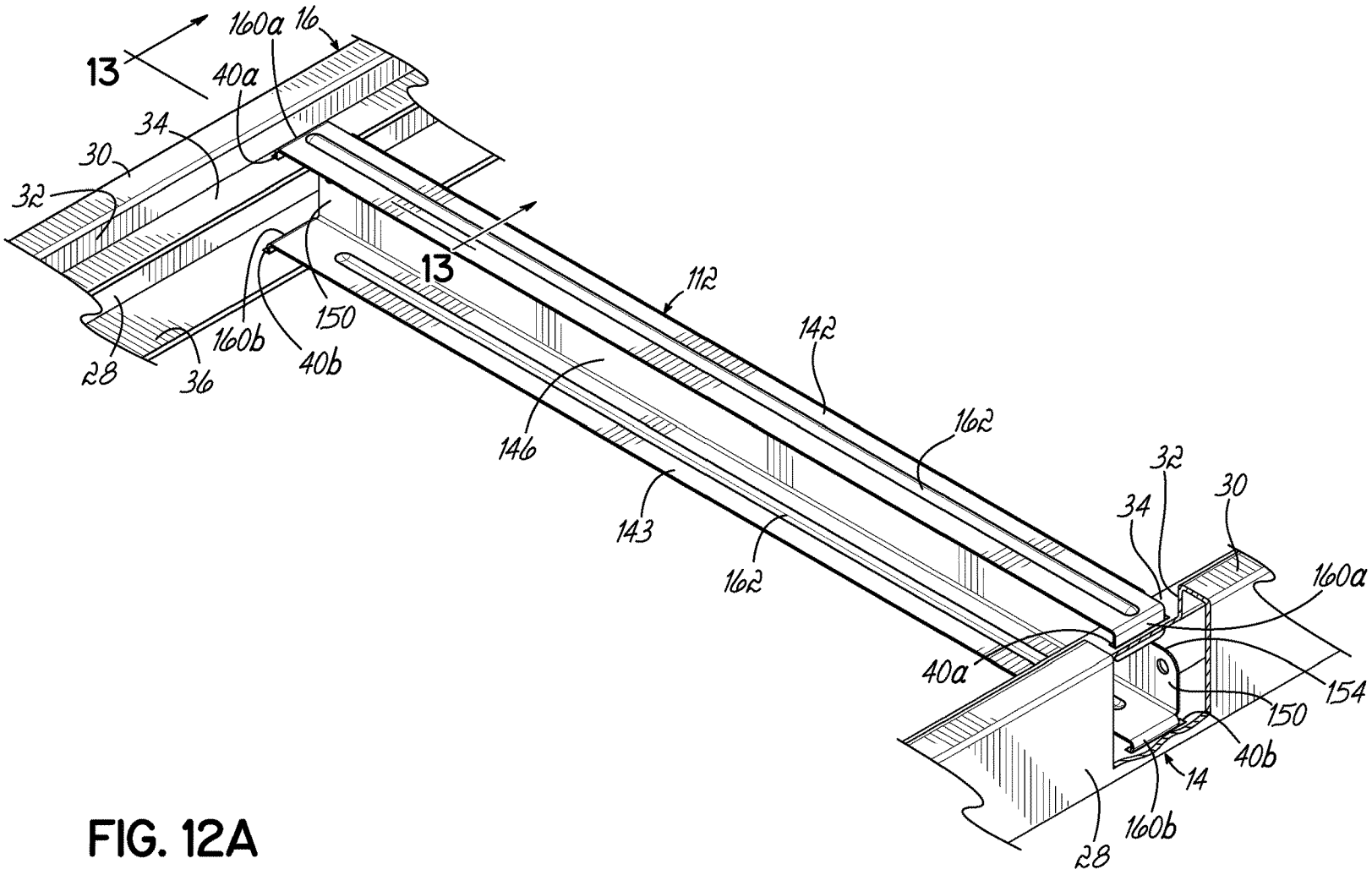
FIG. 12A is a partial isometric view of an exemplary tie bar connecting a pair of front and rear horizontal shelf-supporting beams in accordance with another embodiment of the invention.
Figure 12C:
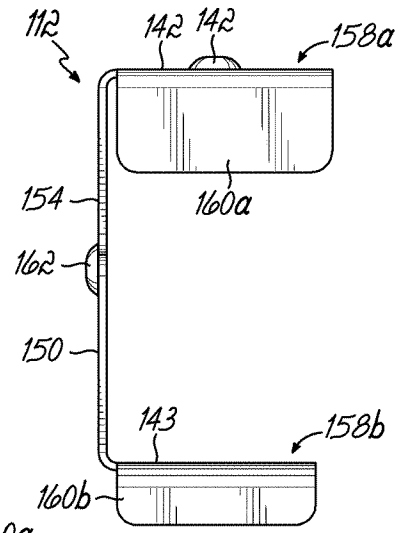
FIG. 12C is an end view of tie bar of FIGS. 12A and 12B.
Figure 12B:
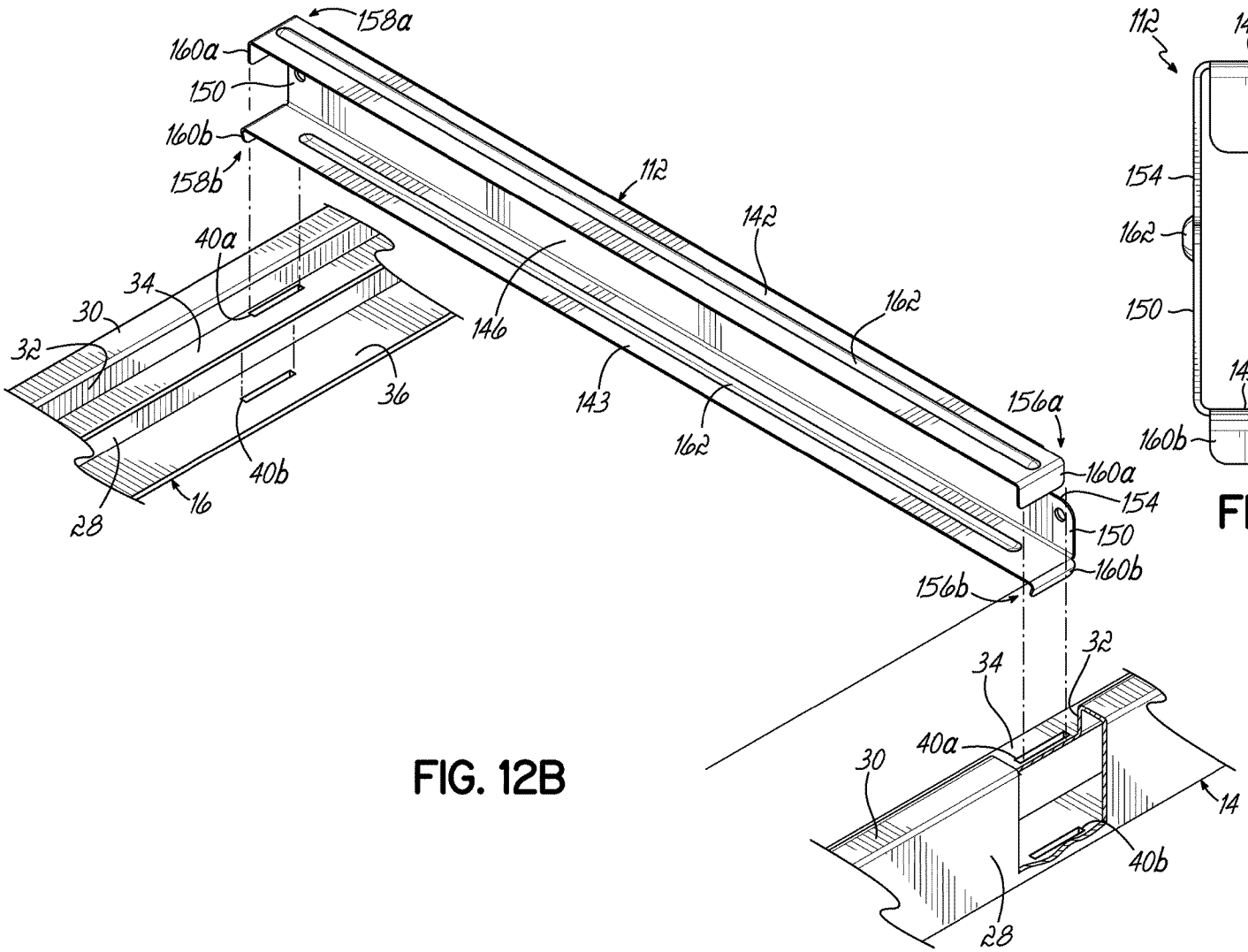
FIG. 12B is an exploded isometric view illustrating the tie bar and associated portions of the shelf-supporting beams of FIG. 12A.
Figure 13:
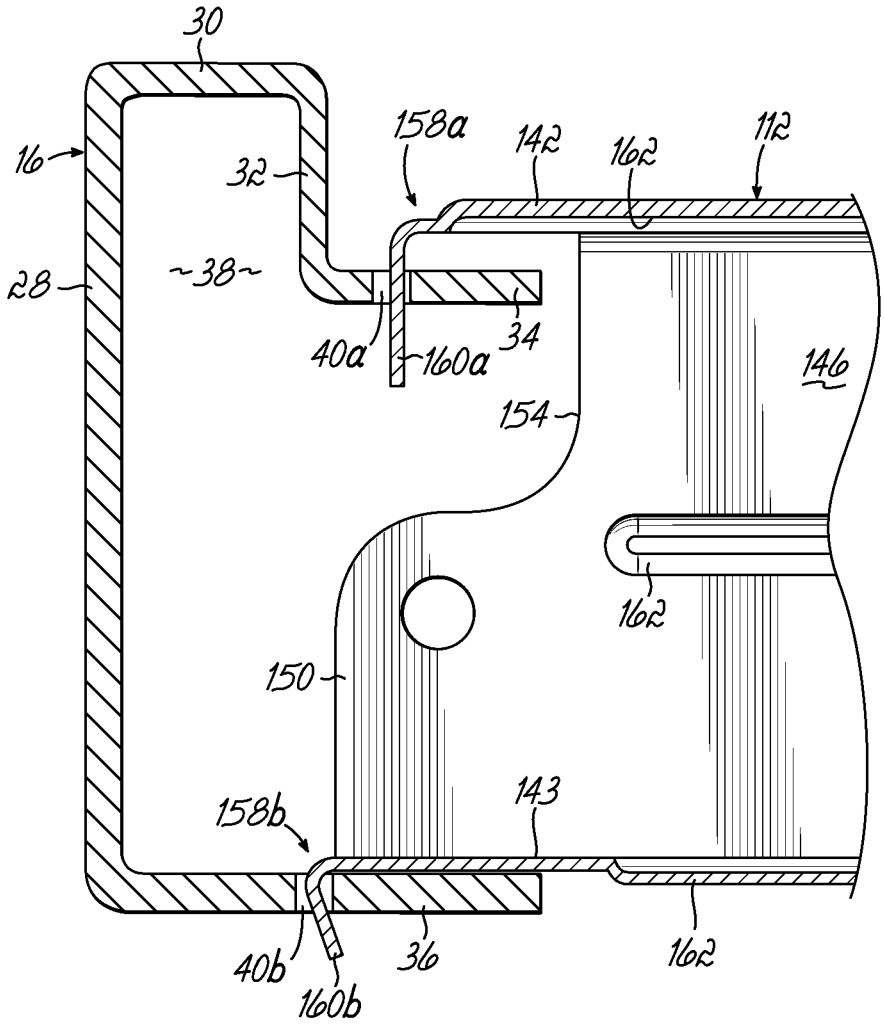
FIG. 13 is a cross-sectional view taken along section line 13-13 of FIG. 12A.

Referring now to FIGS. 12A-13, wherein like numerals represent like features, an alternative tie bar 112 may be used to connect a pair of front and rear beams 14, 16 for improving the structural integrity of the shelving unit 10. In this regard, each beam 14, 16 may include at least one upper longitudinally extending slot 40*a* provided in the horizontal shelf supporting flange 34 and at least one lower longitudinally extending slot 40*b* provided in the lower horizontal flange 36, the purposes of which are discussed below. In the embodiment shown, the upper and lower slots 40*a*, 40*b* are longitudinally aligned and laterally offset from each other. More particularly, the lower slot 40*b* is positioned laterally deeper (e.g., closer to the vertical wall 28) than the upper slot 40*a*.

Each of the tie bars 112 is an elongated member including parallel top and bottom walls 142, 143, and a side wall 146 extending between and perpendicular to lateral sides of the top and bottom walls 142, 143 such that the tie bar 112 has a generally C-shaped cross section (FIG. 12C). In the embodiment shown, the bottom wall 143 is of a greater length than the top wall 142. The side wall 146 includes end extensions 150 which extend longitudinally beyond the terminal ends of the top wall 142 and terminate at or near the terminal ends of the bottom wall 143. Longitudinally extending recesses 154 are provided in the side wall 146 above the end extensions 150 and extend inwardly at or near the terminal ends of the top wall 142. The recesses 154 may each be of sufficient width and depth to receive a portion of the horizontal shelf supporting flange 34 of one of the beams 14, 16, as discussed below.

As shown, each tie bar 112 includes first and second upper hook elements 156*a*, 158*a* at or near respective terminal ends of the top wall 142, and first and second lower hook elements 156*b*, 158*b* at or near respective terminal ends of the bottom wall 143. In this embodiment, the upper hook elements 156*a*, 158*a* each include a depending tab 160*a* extending downwardly from the respective terminal end of the top wall 142 for engagement with one of the upper slots 40*a* of one of the beams 14, 16. Similarly, the lower hook elements 156*b*, 158*b* each include a depending tab 160*b* extending downwardly from the respective terminal end of the bottom wall 143 for engagement with one of the lower slots 40*b* of one of the beams 14, 16. The illustrated lower depending tabs 160*b* are each angled so as to form an acute angle relative to the bottom wall 143. For example, the lower depending tabs 160*b* may be angled at approximately 70° relative to the bottom wall 143. As shown, the end extensions 150 extend longitudinally beyond the respective upper hook elements 156*a*, 158*a* and corresponding tabs 160*a* and terminate at or near the respective lower hook elements 156*b*, 158*b* and corresponding tabs 160*b*, and the lower tabs 60*b* extend longitudinally beyond the upper tabs 60*a*.

In the embodiment shown, a plurality of vertically and/or horizontally extending embossments or ribs 162 are provided on the tie bar 112 for improving the stiffness and rigidity of the tie bar 112. While a total of three horizontal ribs 162 are positioned on the top, bottom and side walls 142, 143, 146 of the illustrated tie bar 112 along substantially the entire lengths thereof, it will be appreciated that any number and/or size of ribs 162 may positioned on any suitable portion of the tie bar 112 in any suitable orientation. For example, the ribs 162 may be positioned on surfaces different from those illustrated. It will be appreciated that the ribs 162 may be formed through a pressing operation or using any other suitable method of formation. Furthermore, the ribs 262 may extend upwardly or downwardly from the walls (e.g., downwardly on the bottom wall).

As best shown in FIGS. 12A, 12B, and 13, in use, the tabs 160*a* of the upper hook elements 156*a*, 158*a* are inserted into and received by the corresponding upper slots 40*a* of the respective front and rear beams 14, 16, and the tabs 160*b* of the lower hook elements 156*b*, 158*b* are inserted into and received by the corresponding lower slots 40*b* of the respective front and rear beams 14, 16. When the tabs 160*a*, 160*b* are received by the slots 40*a*, 40*b*, at least a portion of the bottom wall 143 and/or side wall 146 may rest on, and be supported by, the corresponding lower horizontal flange 36. The angling of the lower tabs 160*b* may assist in preventing dislodgement of the lower tabs 160*b* from the slots 40*b*. The positioning of the tie bar 112 along the respective front and rear beams 14, 16 may be selected based on the locations of the slots 40*a*, 40*b* therealong. The tabs 60*a*, 60*b* of the tie bar 112 may be selectively inserted into opposing slots 40*a*, 40*b* of a pair of front and rear beams 14, 16 to connect the front and rear beams 14, 16 and improve the structural integrity of the shelving unit 10, in a manner similar to that described above with respect to the tie bars 12*a*, 12*b*.

As best shown in FIG. 13, when each tab 160*a*, 160*b* is received in the respective slot 40*a*, 40*b*, a portion of the corresponding horizontal shelf supporting flange 34 is received by the recess 154 in the side wall 146 of the tie bar 112. In this manner, the recesses 154 may accommodate the horizontal shelf supporting flanges 34 such that the side wall 146 of the tie bar 112 may avoid interfering with the insertion of the tabs 160*a*, 160*b* in the respective slots 40*a*, 40*b*. Moreover, when each tab 160*a*, 160*b* is received in the respective slot 40*a*, 40*b*, the corresponding end extensions 150 of the side wall 146 are received in the interior space 38 of the respective beam 14, 16. This configuration may improve the securement of the tie bar 112 to the respective beams 14, 16 and/or improve the structural integrity of the shelving unit 10. For example, the end extensions 150 may aid in rigidifying the tie bar 112 at or near the various interfaces with the beams 14, 16.

Thus, the illustrated tie bar 112 couples to the front and rear horizontal shelf supporting beams 14, 16 at both the upper shelf supporting flange 34 and the lower horizontal flange 36. In this manner, the tie bar 112 may provide the benefits of the tie bars 12*a*, 12*b* as well as the benefits of the tie rods 70, 170. In one embodiment, one or more tie bars 112 may be used alone or in conjunction with one or more tie bars 12*a*, 12*b* and/or tie rods 70, 170 for improving the structural integrity of the shelving unit 10.

Figure 14A:
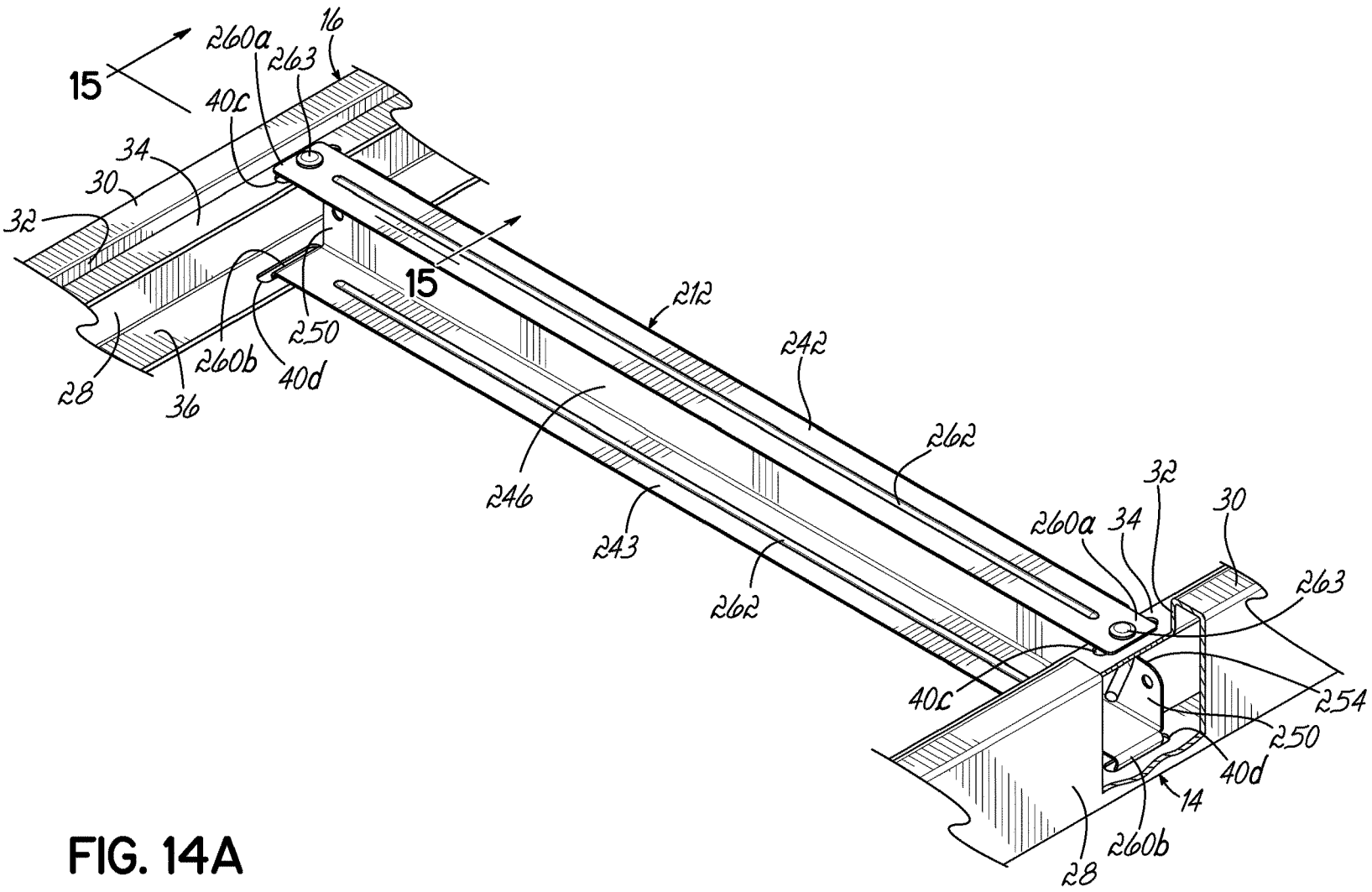
FIG. 14A is a partial isometric view of an exemplary tie bar connecting a pair of front and rear horizontal shelf-supporting beams in accordance with another embodiment of the invention.
Figure 14C:
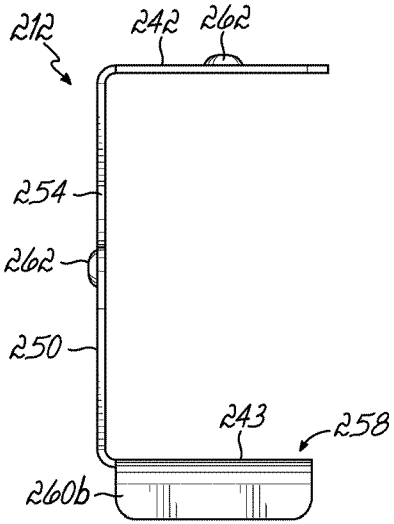
FIG. 14C is an end view of tie bar of FIGS. 14A and 14B.
Figure 14B:
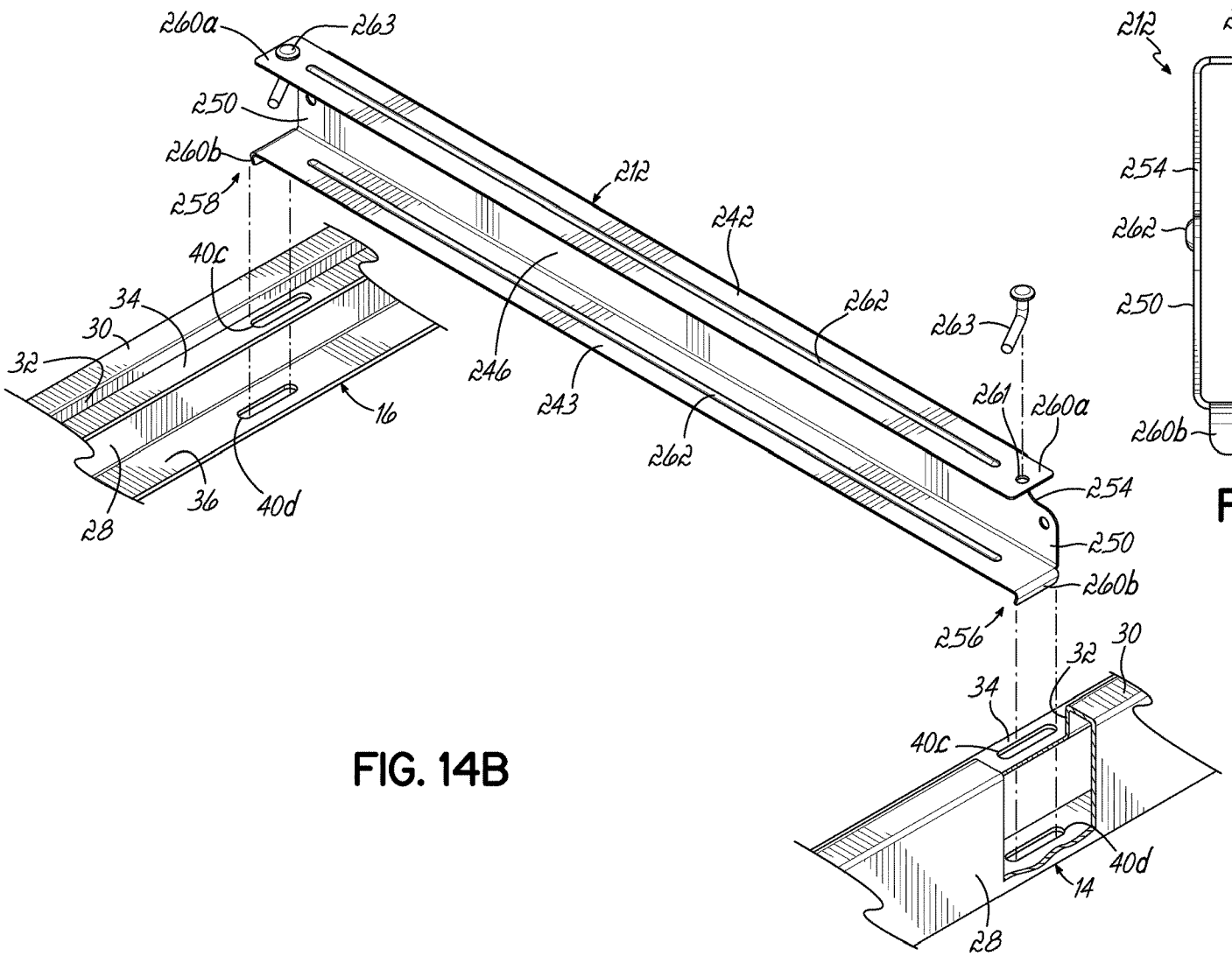
FIG. 14B is an exploded isometric view illustrating the tie bar and associated portions of the shelf-supporting beams of FIG. 14A.
Figure 15:
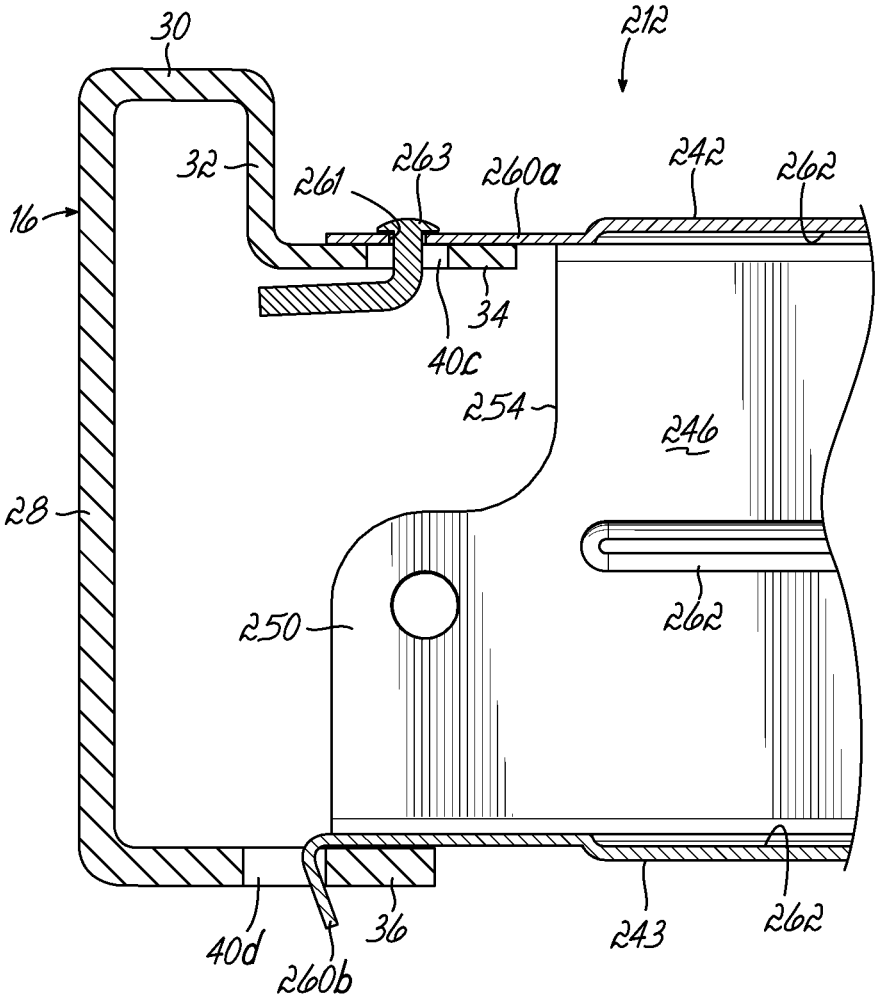
FIG. 15 is a cross-sectional view taken along section line 15-15 of FIG. 14A.

Referring now to FIGS. 14A-15, wherein like numerals represent like features, an alternative tie bar 212 may be used to connect a pair of front and rear beams 14, 16 for improving the structural integrity of the shelving unit 10. In this regard, each beam 14, 16 may include at least one upper longitudinally extending slot 40*c* provided in the horizontal shelf supporting flange 34 and at least one lower longitudinally extending slot 40*d* provided in the lower horizontal flange 36, the purposes of which are discussed below. In the embodiment shown, the upper and lower slots 40*c*, 40*d* are longitudinally aligned and laterally offset from each other. More particularly, the lower slot 40*d* is positioned laterally deeper (e.g., closer to the vertical wall 28) than the upper slot 40*c*.

Each of the tie bars 212 is an elongated member including parallel top and bottom walls 242, 243, and a side wall 246 extending between and perpendicular to lateral sides of the top and bottom walls 242, 243 such that the tie bar 212 has a generally C-shaped cross section (FIG. 14C). In the embodiment shown, the bottom wall 243 is of a greater length than the top wall 242. The side wall 246 includes end extensions 250 which extend longitudinally beyond the terminal ends of the top wall 242 and terminate at or near the terminal ends of the bottom wall 243. Longitudinally extending recesses 254 are provided in the side wall 246 above the end extensions 250 and extend inwardly at or near the terminal ends of the top wall 242. The recesses 254 may each be of sufficient width and depth to receive a portion of the horizontal shelf supporting flange 34 of one of the beams 14, 16, as discussed below.

As shown, each tie bar 212 includes extending tabs 260*a* which extend longitudinally beyond the terminal ends of the top wall 242 within the same plane as the top wall 242, and which each include an aperture 261. Each tie bar 212 also includes first and second hook elements 256, 258 at or near respective terminal ends of the bottom wall 243. In this embodiment, the hook elements 256, 258 each include a depending tab 260*b* extending downwardly from the respective terminal end of the bottom wall 243 for engagement with one of the lower slots 40*d* of one of the beams 14, 16. The illustrated depending tabs 260*b* are each angled so as to form an acute angle relative to the bottom wall 243. For example, the depending tabs 260*b* may be angled at approximately 70° relative to the bottom wall 243. As shown, the end extensions 250 extend longitudinally beyond the respective upper tabs 260*a* and terminate at or near the respective hook elements 256, 258 and corresponding tabs 260*b*, and the lower tabs 260*b* extend longitudinally beyond the upper tabs 260*a*.

In the embodiment shown, a plurality of vertically and/or horizontally extending embossments or ribs 262 are provided on the tie bar 212 for improving the stiffness and rigidity of the tie bar 212. While a total of three horizontal ribs 262 are positioned on the top, bottom and side walls 242, 243, 246 of the illustrated tie bar 212 along substantially the entire lengths thereof, it will be appreciated that any number and/or size of ribs 262 may positioned on any suitable portion of the tie bar 212 in any suitable orientation. For example, the ribs 262 may be positioned on surfaces different from those illustrated. It will be appreciated that the ribs 262 may be formed through a pressing operation or using any other suitable method of formation. Furthermore, the ribs 262 may extend upwardly or downwardly from the walls (e.g., downwardly on the bottom wall).

As best shown in FIGS. 14A, 14B, and 15, in use, the extending tabs 260*a* and/or the top wall 242 rest on, and are supported by, the horizontal shelf supporting flange 34 of the respective front and rear beams 14, 16, and the depending tabs 260*b* of the hook elements 256, 258 are inserted into and received by the corresponding lower slots 40*d* of the respective front and rear beams 14, 16. When the tabs 260*b* are received by the slots 40*d*, at least a portion of the bottom wall 243 and/or side wall 246 may rest on, and be supported by, the corresponding lower horizontal flange 36. The angling of the tabs 260*b* may assist in preventing dislodgement of the tabs 260*b* from the slots 40*b*. In the embodiment shown, each of the apertures 261 is aligned with the corresponding upper slot 40*c* and a pin or rivet 263 is inserted therethrough to assist in securing the tie bar 212 to each of the front and rear beams 14, 16. The rivet 263 may include a bent or angled portion that extends beyond the terminal ends of the upper slot 40*c* such that the tie bar 212 may not be pulled vertically out of position. In addition or alternatively, the shelf 24, 26 may include an opening (not shown) configured for alignment with the upper slot 40*c* and aperture 261 to also receive the rivet 263, thereby additionally securing the shelf 24, 26 to the tie bar(s) 212. In another embodiment, the rivet 263 may be eliminated. In any event, the positioning of the tie bar 212 along the respective front and rear beams 14, 16 may be selected based on the locations of the slots 40*c*, 40*d* therealong. The tabs 260*b* of the tie bar 212 may be selectively inserted into opposing slots 240*b* of a pair of front and rear beams 14, 16 to connect the front and rear beams 14, 16 and improve the structural integrity of the shelving unit 10, in a manner similar to that described above with respect to the tie bars 12*a*, 12*b*, 112.

As best shown in FIG. 15, when each tab 260*b* is received in the respective slot 40*d*, a portion of the corresponding horizontal shelf supporting flange 34 is received by the recess 254 in the side wall 146 of the tie bar 212. In this manner, the recesses 254 may accommodate the horizontal shelf supporting flanges 34 such that the side wall 246 of the tie bar 212 may avoid interfering with the insertion of the tabs 260*b* in the respective slots 40*d*. Moreover, when each tab 260*b* is received in the respective slot 40*d*, the corresponding end extensions 250 of the side wall 246 are received in the interior space 38 of the respective beam 14, 16. This configuration may improve the securement of the tie bar 212 to the respective beams 14, 16 and/or improve the structural integrity of the shelving unit 10. For example, the end extensions 250 may aid in rigidifying the tie bar 212 at or near the various interfaces with the beams 14, 16.

Thus, the illustrated tie bar 212 couples to the front and rear horizontal shelf supporting beams 14, 16 at the lower horizontal flange 36, and is supported by and optionally coupled to the upper shelf supporting flange 34. In this manner, the tie bar 212 may provide the benefits of the tie bars 12*a*, 12*b* as well as the benefits of the tie rods 70, 170. In one embodiment, one or more tie bars 212 may be used alone or in conjunction with one or more tie bars 12*a*, 12*b*, 112 and/or tie rods 70, 170 for improving the structural integrity of the shelving unit 10.

While the present invention has been illustrated by the description of various embodiments thereof, and while the embodiments have been described in considerable detail, it is not intended to restrict or in any way limit the scope of the appended claims to such detail. Thus, the various features discussed herein may be used alone or in any combination. Additional advantages and modifications will readily appear to those skilled in the art. The invention in its broader aspects is therefore not limited to the specific details and illustrative examples shown and described. Accordingly, departures may be made from such details without departing from the scope of the general inventive concept.

What is claimed is:

1. A tie bar for connecting two horizontal beams of a shelving unit, the tie bar comprising:

first and second elongate walls arranged parallel to each other;

a third elongate wall arranged perpendicular to the first and second elongate walls and coupled to a lateral side of each of the first and second elongate walls; and one of the first or second elongate walls including a pair of hook elements positioned at terminal ends of the one of the first or second elongate walls, wherein each of the hook elements includes a depending downwardly-extending tab integrally formed with the one of the first or second elongate walls and configured to be received by an elongate slot of at least one of the two horizontal beams of the shelving unit;

wherein the other of the first or second elongate walls is free of any depending downwardly-extending tabs; and wherein the first and second elongate walls are top and bottom walls, respectively, the third elongate wall is a side wall, and the pair of hook elements being positioned on the second elongate wall.

2. The tie bar of claim 1, wherein the third elongate wall includes end extensions extending longitudinally beyond the terminal ends of the first elongate wall and wherein the end extensions are each configured to be received within an interior space of the corresponding horizontal beam.

3. The tie bar of claim 1, wherein the third elongate wall includes recesses extending inwardly at or near the terminal ends of the first elongate wall and wherein the recesses are each configured to receive a portion of a flange of the corresponding horizontal beam.

4. The tie bar of claim 1, further comprising first and second extending tabs positioned at and extending longitudinally beyond the terminal ends of the first elongate wall, the first and second extending tabs being planar with the first elongate wall.

5. The tie bar of claim 4, wherein each of the first and second extending tabs includes an opening spaced away from the terminal ends of the first elongate wall for receiving a pin configured to securely couple the first elongate wall to the corresponding beam.

6. The tie bar of claim 5, further comprising a pin received by the opening to securely couple the first elongate wall to the corresponding beam.

7. The tie bar of claim 1, wherein the first elongate wall is free of any depending tabs.

8. The tie bar of claim 1, wherein at least one of the elongate walls includes an embossment.

9. A shelving unit comprising the tie bar of claim 1.

10. A shelving unit comprising:

at least one front horizontal shelf-supporting beam including at least one first flange, at least one first elongate slot, and at least one first interior space;

at least one rear horizontal shelf-supporting beam including at least one second flange, at least one second elongate slot, and at least one second interior space; and a tie bar connecting the at least one front and rear horizontal shelf-supporting beams, the tie bar including:

first and second elongate walls arranged parallel to each other;

a third elongate wall arranged perpendicular to the first and second elongate walls and coupled to a lateral side of each of the first and second elongate walls; and one of the first or second elongate walls including a pair of hook elements positioned at terminal ends of the one of the first or second elongate walls, wherein each of the hook elements includes a depending downwardly-extending tab integrally formed with the one of the first or second elongate walls and received by one of the at least one first or second elongate slots;

wherein the other of the first or second elongate walls is free of any depending downwardly-extending tabs; and wherein the first and second elongate walls are top and bottom walls, respectively, the third elongate wall is a side wall, and the pair of hook elements being positioned on the second elongate wall.

11. The shelving unit of claim 10, wherein the third elongate wall includes recesses extending inwardly at or near the terminal ends of the first elongate wall and wherein the recesses each receive a portion of one of the at least one first or second flanges.

12. The shelving unit of claim 10, further comprising first and second extending tabs positioned at and extending longitudinally beyond the terminal ends of the first elongate wall, the first and second extending tabs being planar with the first elongate wall.

13. The shelving unit of claim 12, wherein each of the first and second extending tabs includes an opening spaced away from the terminal ends of the first elongate wall for receiving a pin configured to securely couple the first elongate wall to the corresponding beam.

14. The shelving unit of claim 13, further comprising a pin received by the opening to securely couple the first elongate wall to the corresponding beam.

15. The shelving unit of claim 10, wherein the first elongate wall is free of any depending tabs.

16. A tie bar for connecting two horizontal beams of a shelving unit, the tie bar comprising:

first and second elongate walls arranged parallel to each other;

a third elongate wall arranged perpendicular to the first and second elongate walls and coupled to a lateral side of each of the first and second elongate walls; and one of the first or second elongate walls including a pair of hook elements positioned at terminal ends of the one of the first or second elongate walls, wherein each of the hook elements includes a depending downwardly-extending tab integrally formed with the one of the first or second elongate walls and configured to be received by an elongate slot of at least one of the two horizontal beams of the shelving unit;

wherein the other of the first or second elongate walls is free of any depending downwardly-extending tabs; and wherein the tie bar is a monolithic body.

17. The tie bar of claim 16, wherein the first and second elongate walls are top and bottom walls, respectively, the third elongate wall is a side wall, and the pair of hook elements being positioned on the second elongate wall.

18. The tie bar of claim 16, further comprising:

first and second extending tabs positioned at and extending longitudinally beyond the terminal ends of the first elongate wall, each extending tab includes an opening; and a pin received by each opening for securely coupling the first elongate wall to the corresponding beam.

19. A tie bar for connecting two horizontal beams of a shelving unit, the tie bar comprising:

first and second elongate walls arranged parallel to each other;

a third elongate wall arranged perpendicular to the first and second elongate walls and coupled to a lateral side of each of the first and second elongate walls; and one of the first or second elongate walls including a pair of hook elements positioned at terminal ends of the one of the first or second elongate walls, wherein each of the hook elements includes a depending downwardly-extending tab integrally formed with the one of the first or second elongate walls and configured to be received by an elongate slot of at least one of the two horizontal beams of the shelving unit;

wherein the other of the first or second elongate walls is free of any depending downwardly-extending tabs; and wherein the first, second, and third elongate walls are configured to extend perpendicular to the two horizontal beams.

20. The tie bar of claim 19, wherein the first and second elongate walls are top and bottom walls, respectively, the third elongate wall is a side wall, and the pair of hook elements being positioned on the second elongate wall.

21. The tie bar of claim 19, further comprising:

first and second extending tabs positioned at and extending longitudinally beyond the terminal ends of the first elongate wall, each extending tab includes an opening; and a pin received by each opening for securely coupling the first elongate wall to the corresponding beam.

22. A tie bar for connecting two horizontal beams of a shelving unit, the tie bar comprising:

first and second elongate walls arranged parallel to each other;

a third elongate wall arranged perpendicular to the first and second elongate walls and coupled to a lateral side of each of the first and second elongate walls; and one of the first or second elongate walls including a pair of hook elements positioned at terminal ends of the one of the first or second elongate walls, wherein each of the hook elements includes a depending downwardly-extending tab integrally formed with the one of the first or second elongate walls and configured to be received by an elongate slot in and extending along the length of at least one of the two horizontal beams of the shelving unit;

wherein the other of the first or second elongate walls is free of any depending downwardly-extending tabs.

23. The tie bar of claim 22, wherein the first and second elongate walls are top and bottom walls, respectively, the third elongate wall is a side wall, and the pair of hook elements being positioned on the second elongate wall.

24. The tie bar of claim 22, further comprising:

first and second extending tabs positioned at and extending longitudinally beyond the terminal ends of the first elongate wall, each extending tab includes an opening; and a pin received by each opening for securely coupling the first elongate wall to the corresponding beam.

25. A shelving unit comprising:

at least one front horizontal shelf-supporting beam including at least one first flange, at least one first elongate slot, and at least one first interior space;

at least one rear horizontal shelf-supporting beam including at least one second flange, at least one second elongate slot, and at least one second interior space; and a monolithic tie bar connecting the at least one front and rear horizontal shelf-supporting beams, the tie bar including:

first and second elongate walls arranged parallel to each other;

a third elongate wall arranged perpendicular to the first and second elongate walls and coupled to a lateral side of each of the first and second elongate walls; and one of the first or second elongate walls including a pair of hook elements positioned at terminal ends of the one of the first or second elongate walls, wherein each of the hook elements includes a depending downwardly-extending tab integrally formed with the one of the first or second elongate walls and received by one of the at least one first or second elongate slots; and wherein the other of the first or second elongate walls is free of any depending downwardly-extending tabs.

26. The shelving unit of claim 25, wherein the first and second elongate walls are top and bottom walls, respectively, the third elongate wall is a side wall, and the pair of hook elements being positioned on the second elongate wall.

27. The shelving unit of claim 25, further comprising:

first and second extending tabs positioned at and extending longitudinally beyond the terminal ends of the first elongate wall, each extending tab includes an opening; and a pin received by each opening to securely couple the first elongate wall to the corresponding beams.

28. A shelving unit comprising:

at least one front horizontal shelf-supporting beam including at least one first flange, at least one first elongate slot, and at least one first interior space;

at least one rear horizontal shelf-supporting beam including at least one second flange, at least one second elongate slot, and at least one second interior space; and a tie bar connecting the at least one front and rear horizontal shelf-supporting beams, the tie bar including:

first and second elongate walls arranged parallel to each other;

a third elongate wall arranged perpendicular to the first and second elongate walls and coupled to a lateral side of each of the first and second elongate walls; and one of the first or second elongate walls including a pair of hook elements positioned at terminal ends of the one of the first or second elongate walls, wherein the first, second, and third elongate walls extend perpendicular to the two horizontal beams; and wherein each of the hook elements includes a depending downwardly-extending tab integrally formed with the one of the first or second elongate walls and received by one of the at least one first or second elongate slots; and wherein the other of the first or second elongate walls is free of any depending downwardly-extending tabs.

29. The shelving unit of claim 28, wherein the first and second elongate walls are top and bottom walls, respectively, the third elongate wall is a side wall, and the pair of hook elements being positioned on the second elongate wall.

30. The shelving unit of claim 28, further comprising:

first and second extending tabs positioned at and extending longitudinally beyond the terminal ends of the first elongate wall, each extending tab includes an opening; and a pin received by each opening to securely couple the first elongate wall to the corresponding beams.

31. A shelving unit comprising:

at least one front horizontal shelf-supporting beam including at least one first flange, at least one first elongate slot extending along the length of the front beam, and at least one first interior space;

at least one rear horizontal shelf-supporting beam including at least one second flange, at least one second elongate slot, and at least one second interior space; and a tie bar connecting the at least one front and rear horizontal shelf-supporting beams, the tie bar including:

first and second elongate walls arranged parallel to each other;

a third elongate wall arranged perpendicular to the first and second elongate walls and coupled to a lateral side of each of the first and second elongate walls; and one of the first or second elongate walls including a pair of hook elements positioned at terminal ends of the one of the first or second elongate walls, wherein each of the hook elements includes a depending downwardly-extending tab integrally formed with the one of the first or second elongate walls and received by one of the at least one first or second elongate slots; and wherein the other of the first or second elongate walls is free of any depending downwardly-extending tabs.

32. The shelving unit of claim 31, wherein the first and second elongate walls are top and bottom walls, respectively, the third elongate wall is a side wall, and the pair of hook elements being positioned on the second elongate wall.

33. The shelving unit of claim 31, further comprising:

first and second extending tabs positioned at and extending longitudinally beyond the terminal ends of the first elongate wall, each extending tab includes an opening; and a pin received by each opening to securely couple the first elongate wall to the corresponding beams.

* * * * *